US010053902B1

(12) United States Patent
White et al.

(10) Patent No.: US 10,053,902 B1
(45) Date of Patent: Aug. 21, 2018

(54) SOFT CLOSE HINGE ASSEMBLY

(71) Applicant: Mansfield Engineered Components, Inc., Mansfield, OH (US)

(72) Inventors: Brian White, Shelby, OH (US); James Collene, Bucyrus, OH (US)

(73) Assignee: Mansfield Engineered Components, Inc., Mansfield, OH (US)

( * ) Notice: Subject to any disclaimer, the term of this patent is extended or adjusted under 35 U.S.C. 154(b) by 260 days.

(21) Appl. No.: 14/840,772

(22) Filed: Aug. 31, 2015

Related U.S. Application Data

(62) Division of application No. 14/069,324, filed on Oct. 31, 2013, now Pat. No. 9,121,211.

(60) Provisional application No. 61/720,530, filed on Oct. 31, 2012.

(51) Int. Cl.

| | |
|---|---|
| ***E05F 1/08*** | (2006.01) |
| ***E05F 3/20*** | (2006.01) |
| ***E05F 3/10*** | (2006.01) |
| ***E05F 3/02*** | (2006.01) |
| ***E05F 3/18*** | (2006.01) |

(52) U.S. Cl.
CPC ..... *E05F 3/20* (2013.01); *E05F 3/02* (2013.01); *E05F 3/10* (2013.01); *E05F 3/18* (2013.01)

(58) Field of Classification Search
CPC ..... E05F 3/20; E05F 3/02; E05F 3/10; E05F 3/18; E05F 1/1261; Y10T 16/5383; Y10T 16/53834; E05Y 2201/21; E05Y 2201/264; E05Y 2900/308
See application file for complete search history.

(56) References Cited

U.S. PATENT DOCUMENTS

| | | | |
|---|---|---|---|
| 1,228,042 | A | 5/1917 | O'Dowd |
| 1,253,376 | A | 1/1918 | Hick |
| 3,712,287 | A | 1/1973 | Summers, Jr. |
| 5,269,043 | A | 12/1993 | Yang |
| 6,041,548 | A | 3/2000 | Miller |
| 6,397,836 | B1 | 6/2002 | Pelletier et al. |
| 6,789,293 | B2 | 9/2004 | Habegger et al. |
| 6,845,545 | B2 | 1/2005 | Han et al. |
| 7,676,888 | B2 | 3/2010 | Vanini |

(Continued)

FOREIGN PATENT DOCUMENTS

| | | | |
|---|---|---|---|
| DE | 29 39 727 | A1 | 4/1981 |
| DE | 10 2005 045 365 | A1 | 3/2007 |

(Continued)

*Primary Examiner* — Victor D Batson
*Assistant Examiner* — Matthew J Sullivan
(74) *Attorney, Agent, or Firm* — Fay Sharpe LLP

(57) ABSTRACT

A hinge assembly includes a lever arm and a channel connected to the lever arm. The channel is adapted to be connected to an associated appliance door. A control link is pivotally connected to the lever arm. A slide body includes an inner end connected to the control link. The slide body is adapted for sliding movement in response to pivoting movement of the channel relative to the lever arm between a first (door-closed) position and a second (door-opened) position. A spring resiliently biases the channel toward the first position. A snubber system includes at least one snubber with a piston that is biased to an extended position and moveable to a retracted position against a fluid or other damping resistance during movement of the slide body away when the channel moves from the first position to the second position.

16 Claims, 32 Drawing Sheets

(56) References Cited

U.S. PATENT DOCUMENTS

| | | | | |
|---|---|---|---|---|
| 8,544,971 | B2 | 10/2013 | Stocker | |
| 8,707,519 | B2 | 4/2014 | Elkasevic et al. | |
| 8,806,718 | B2 | 8/2014 | Elkasevic | |
| 8,806,719 | B2 | 8/2014 | Kleeman et al. | |
| 8,925,542 | B2 | 1/2015 | White et al. | |
| 2006/0032019 | A1 | 2/2006 | Kistner et al. | |
| 2007/0283532 | A1* | 12/2007 | Vanini | E05F 5/10 16/277 |
| 2008/0078373 | A1 | 4/2008 | Kim et al. | |
| 2008/0201907 | A1 | 8/2008 | Vanini | |
| 2008/0289144 | A1 | 11/2008 | Vanini | |
| 2010/0148646 | A1* | 6/2010 | Bettinzoli | E05F 1/1261 312/326 |
| 2010/0281650 | A1* | 11/2010 | Kleemann | A47L 15/4261 16/64 |
| 2011/0068671 | A1 | 3/2011 | Vanini | |
| 2011/0113816 | A1* | 5/2011 | Stocker | E05F 1/1207 62/449 |
| 2011/0146654 | A1 | 6/2011 | Basavalingappa Mudbasal et al. | |
| 2011/0146655 | A1 | 6/2011 | Basavalingappa Mudbasal et al. | |
| 2011/0148262 | A1 | 6/2011 | Basavalingappa Mudbasal et al. | |
| 2012/0067333 | A1* | 3/2012 | Mirshekari | E05F 1/1041 126/192 |
| 2013/0291853 | A1 | 11/2013 | Braden et al. | |
| 2013/0300273 | A1 | 11/2013 | Elkasevic et al. | |
| 2013/0300274 | A1 | 11/2013 | Elkasevic et al. | |
| 2013/0307392 | A1 | 11/2013 | Elkasevic et al. | |
| 2013/0312217 | A1 | 11/2013 | Kleeman et al. | |
| 2013/0312219 | A1 | 11/2013 | Elkasevic | |
| 2013/0312220 | A1 | 11/2013 | Elkasevic | |
| 2013/0312221 | A1 | 11/2013 | Elkasevic | |

FOREIGN PATENT DOCUMENTS

| | | | |
|---|---|---|---|
| DE | 10 2007 029 696 | A1 | 1/2009 |
| DE | 20 2007 012 603 | U1 | 2/2009 |
| EP | 1 884 181 | A1 | 2/2008 |
| EP | 2 284 344 | A2 | 2/2011 |
| WO | WO 2008/142711 | A1 | 11/2008 |
| WO | WO 2009/030618 | A1 | 3/2009 |
| WO | WO 2009/033960 | A1 | 3/2009 |
| WO | WO 2010/091770 | A1 | 8/2010 |

* cited by examiner

SOFT CLOSE HINGE ASSEMBLY

CROSS-REFERENCE TO RELATED APPLICATIONS

This application is a divisional of U.S. application Ser. No. 14/069,324 filed Oct. 31, 2013, now assigned U.S. Pat. No. 9,121,211, which claims priority from and benefit of the filing date of U.S. provisional application Ser. No. 61/720,530 filed Oct. 31, 2012, and the entire disclosure of each of these prior applications is hereby expressly incorporated by reference into the present application.

BACKGROUND

Hinge assemblies for appliance doors are known to include a damper such as a pneumatic or hydraulic damper with a selectively extensible and retractable rod pivotally connected to a first component of the hinge assembly and a body pivotally connected to a second component of the hinge assembly such that the damper rod is extended and retracted in response to pivoting movement of the first and second hinge assembly components relative to each other. The pneumatic or hydraulic damper, which optionally includes an internal biasing spring, provides the desired damping characteristics to the hinge assembly to provide a soft close appliance door.

These known hinge assemblies are effective, durable, and otherwise exhibit desired performance characteristics, but the dampers are large, heavy, expensive, and complicate design and manufacture of the hinge assembly in that a change in damping characteristics requires a change of the internal components of the pneumatic or hydraulic damper, such as the piston and/or spring, which can increase cost and time required for damper design and manufacturing changes. Conventional pneumatic and hydraulic dampers often require that the overall structure of the hinge assembly be changed to accommodate the damper in place of a conventional coil spring. Furthermore, conventional dampers are operative to act on the hinge assembly over its full range of motion, which is sometimes not a preferred characteristic.

Based upon the above noted issues and others, a need has been identified for a new and improved appliance hinge assembly that provides desired soft close characteristics while overcoming the above-noted deficiencies and others associated with conventional pneumatic and/or hydraulic dampers.

SUMMARY

In accordance with a first aspect of the present development, a hinge assembly for an appliance includes a lever arm adapted to be engaged with a mounting receptacle of an associated appliance body and a channel pivotally connected to the lever arm at a first pivot point. The channel is adapted to be connected to an associated appliance door. A control link includes inner and outer ends, and the inner end of the control link is pivotally connected to the lever arm. A slide body is located adjacent the channel and includes an inner end connected to the outer end of the control link. The slide body is adapted for reciprocal sliding movement relative to the channel toward and away from the first pivot point in response to pivoting movement of the channel relative to the lever arm between a first position and a second position. A spring is operably located between the slide body and the channel and resiliently biases the channel toward the first position. A snubber system is connected to the channel in a location where the slide body is located between the snubber system and the first pivot point. The snubber system includes at least one snubber comprising a piston that is biased to an extended position and selectively moveable to a retracted position against a damping resistance. The slide body contacts the snubber system during movement of the slide body away from the first pivot point when the channel moves from the first position to the second position and the slide body causes movement of the snubber piston from its extended position to its retracted position such that the snubber system damps movement of the slide body away from the first pivot point and damps movement of the channel toward its first position.

In accordance with another aspect of the present development, a hinge assembly for an appliance includes a lever arm adapted to be engaged with a mounting receptacle of an associated appliance body. A channel is pivotally connected to the lever arm at a first pivot point, and the channel is adapted to be connected to an associated appliance door. The channel includes a stop. A control link includes inner and outer ends, and the inner end of the control link is pivotally connected to the lever arm. A slide body is located adjacent the channel and includes an inner end connected to the outer end of the control link. The slide body is adapted for reciprocal sliding movement relative to the channel toward and away from the first pivot point in response to pivoting movement of the channel relative to the lever arm between a first position and a second position. A spring is operably located between the slide body and the channel and resiliently biases the channel toward the first position. A snubber system is connected to the slide body. The snubber system includes at least one snubber including a piston that is biased to an extended position and selectively moveable to a retracted position against a damping resistance. The slide body and the snubber system move away from the first pivot point when the channel moves from the first position to the second position, and the snubber system contacts the stop when the channel is located in an intermediate position located between the second position and the first position. Movement of the channel from the intermediate position toward the first position causes movement of the snubber piston from its extended position to its retracted position such that the snubber system damps movement of the slide body away from the first pivot point and damps movement of the channel toward its first position.

DETAILED DESCRIPTION

First Embodiment

Figure 1:
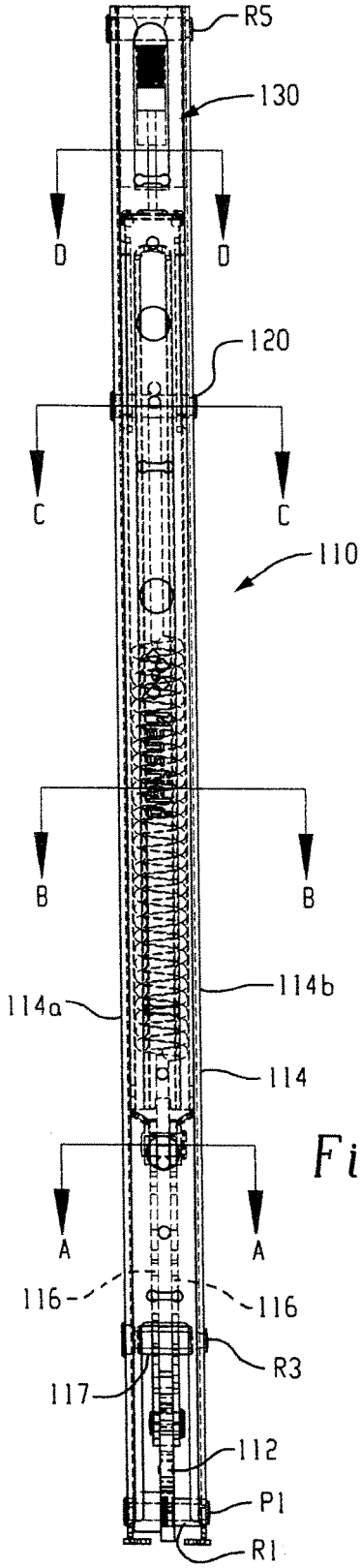
FIGS. 1 and 2 are front and side views that show a hinge assembly in accordance with a first embodiment.

Referring to a first embodiment shown in FIGS. 1-8A, a hinge assembly 110 is intended to be used as one member of a pair of hinge assemblies H1,H2 (FIG. 8A) used to mount a door D to an appliance body B of an oven O or other appliance to allow the door to be moved pivotally between opened and closed positions relative to a cooking chamber, washing chamber, or other internal space or chamber C of the appliance, with the hinge assembly 110 and its corresponding pair member being mounted adjacent opposite lateral sides of the chamber C and also being mounted to the appliance door. As used herein, the term "door" includes a "lid" such as used to close a top-loading washer or other top-loading appliance chamber. The hinge assembly 110 can be used with a like hinge assembly 110 or a different hinge assembly to form the pair of hinge assemblies H1,H2 used to operatively connect the door D to the appliance body B as described.

The hinge assembly 110 comprises a "claw" or lever arm 112 adapted to be engaged with a mounting receptacle or "pocket" of the appliance body B to secure the hinge assembly 110 in its operative position. A channel 114 is pivotally connected at its first (inner) end to the lever arm 112 at a first pivot point P1 by a first rivet or other fastener(s) R1, and the channel 114 is adapted to be connected to the appliance lid or door D used for selectively closing the internal space of the appliance. The channel 114 includes an internal recess or space such as the space S (see FIGS. 1A-1D) defined between its first and second parallel side walls 114*a*,114*b* and a front wall 114*c* that extends between and connects the side walls 114*a*,114*b* when the channel is defined with a U-shaped cross-section as shown, although the channel 114 need not be defined with the illustrated U-shaped cross-sectional structure. The lever arm 112 projects through an opening in the front wall 114*c* into the space S between the side walls 114*a*,114*b*.

One or more control links 116 (e.g., first and second parallel links 116 as shown herein) are also located in the space S and are connected at their first or inner ends 116*a* to the lever arm 112 at a second pivot point P2 using a second rivet or other fastener(s) R2. The pivot points P1 and P2 are spaced apart or offset from each other. The control links 116 are engaged with/by a bushing, roller, or other control member or follower 117 that is connected to the channel side walls 114*a*,114*b* and located in the space S. As shown, the control follower 117 comprises a roller carried by a third rivet or other fastener R3 that extends between the side walls 114*a*,114*b*, and each control link 116 includes an elongated contoured slot 116*s* in which the roller 117 is located such that the control link 116 is able to reciprocate in the space S in a controlled manner while being captured in the space S by the roller of the control follower 117. Alternatively, the roller of the control follower 117 can be replaced by a fixed, low friction polymeric or metal bushing or other structure, such as the third rivet R3, itself. Also, the contoured slot 116*s* of each control link 116 can be eliminated, in which case the control follower 117 is abutted by and engaged with a contoured peripheral edge of each control link 116 as each control link 116 moves relative to the control follower 117 during pivoting movement of the channel 114 relative to the lever arm 112.

As shown, the lever arm 112, channel 114 and each control link 116 are provided as respective one-piece metal structures formed by a stamping process or other metal forming method, but each can alternatively be provided by a fabricated multi-piece structure and/or by a non-metallic structure such as a polymeric structure.

A slide body or inner slide body 118 is located adjacent the channel 114, e.g., located in the space S, nested between the channel side walls 114*a*,114*b* or otherwise connected to and/or located adjacent the channel 114. The inner slide body 118 is shown as a one-piece metal structure formed by a stamping process or another metal forming method, but it can alternatively be provided by a fabricated multi-piece structure and/or by a non-metallic structure such as a polymeric structure. A second or outer end 116*b* of each control link 116 is pivotally connected to a first or inner end 118*x* of the slide body 118 by a fourth rivet R4 or other fastener which is sometimes referred to herein as the slide body fastener. The opposite second or outer end 118*y* of the slide body 118 is slidably connected to the channel 114 such that the slide body 118 is able to reciprocate along the longitudinal axis of the channel 114 within the space S and parallel to the side walls 114*a*,114*b* when the channel 114 is pivoted relative to the lever arm 112 about the pivot point P1. In the illustrated embodiment, the slide body 118 is at least partially defined with a U-shaped cross-section and includes first and second parallel side walls 118*a*,118*b* (FIGS. 5 and 6) and an end wall 118*c* that extends between the first and second side walls 118*a*,118*b*. The slide body 118 is closely nested in the space S between the channel side walls 114*a*,114*b*. The slide body side walls 118*a*,118*b* include respective elongated slots 119*a*,119*b* (FIGS. 5 and 6) that are aligned with each other. The slide body 118 is slidably captured in the space S by a slide pin or slide fastener 120 such as a rivet or pin that extends between the channel side walls 114*a*,114*b* and that also extends through the elongated slots 119*a*,119*b* as is also shown in the section view of FIG. 1C. In alternative embodiments, the slide body 118 is slidably captured in the space S of the channel by other structures, e.g., projecting ears or tabs of the slide body 118 that are engaged with respective slots defined in the channel side walls 114*a*,114*b*, separate slide fasteners respectively connected to the opposite channel side walls 114*a*,114*b* and respectively engaged with the slide body elongated slots 119*a*,119*b*, or by any other suitable sliding interengagement of the slide body 118 with the channel 114. In another embodiment, the slide body includes only a single elongated slot 119*a* or 119*b* through which the slide pin/fastener 120 extends.

Those of ordinary skill in the art will recognize that pivoting movement of the channel 114 relative to the lever arm 112 from its first (door-closed) position (FIG. 2) toward its second (door-opened) position (FIG. 4) during opening of the appliance door will cause the slide body 118 to move in the space S toward the pivot point P1 and away from the second (outer) end of the channel 114, while pivoting movement of the channel 114 relative to the lever arm 112 in the opposite direction during closing of the appliance door will cause the slide body 118 to move away from the first pivot point P1 and toward the second (outer) end of the channel 114.

A spring 122 such as the illustrated helical coil spring (or a gas spring or other type of spring) is connected at its first or inner end 122*a* directly or indirectly to the first/inner end of the slide body 118 and/or the control link(s) 116 (e.g., via rivet R4 or other fastener that connects the control link(s) 116 to the slide body 118), and an opposite second or outer end 122*b* of the spring 122 is connected directly or indirectly to the channel 114 at a location spaced from the pivot point P1, e.g., via slide fastener 120. Those of ordinary skill in the art will recognize that the spring is thus operably located between the slide body and the channel and resiliently biases the channel toward the first position (door-closed) by urging the slide body and the control link(s) 116 away from the first pivot point P1.

Figure 2:
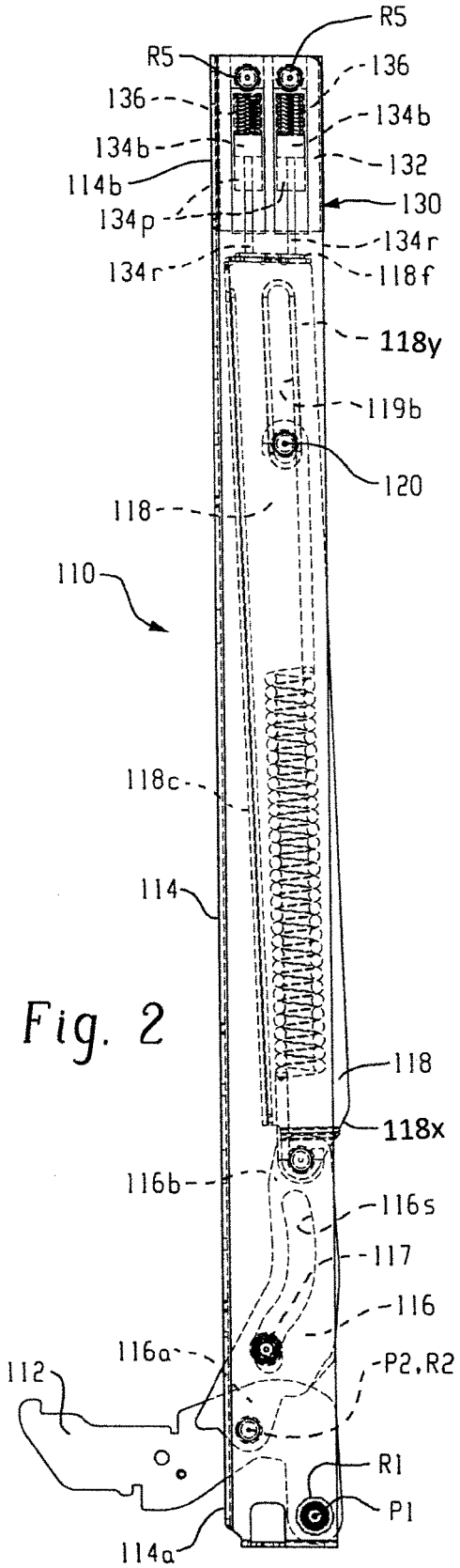
Figure 1A:
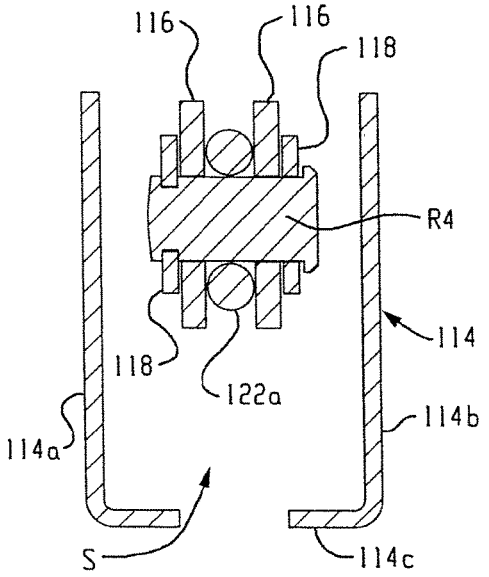
FIGS. 1A, 1B, 1C and 1D are section views taken respectively at lines A-A, B-B, C-C and D-D of FIG. 1.
Figure 1C:
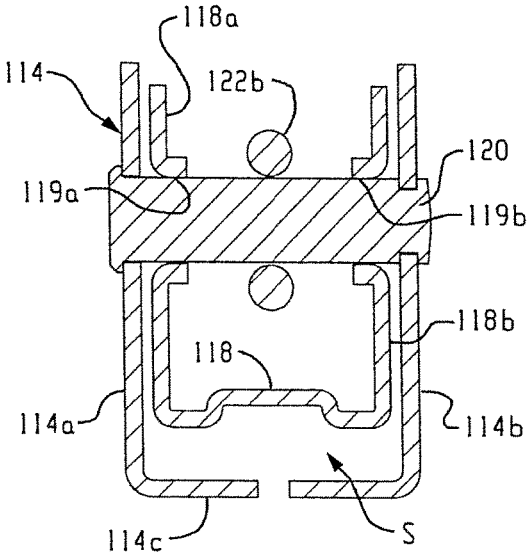
Figure 1B:
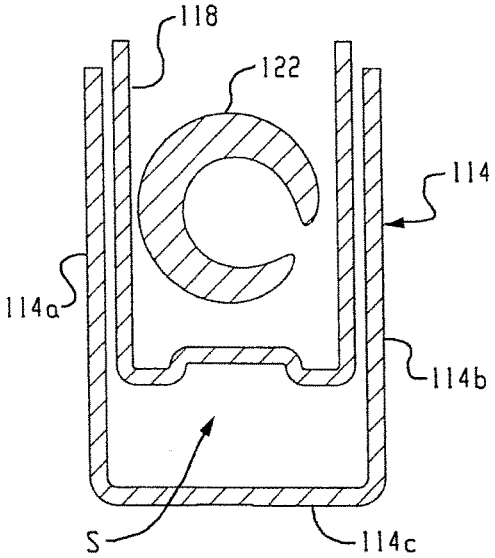
Figure 1D:
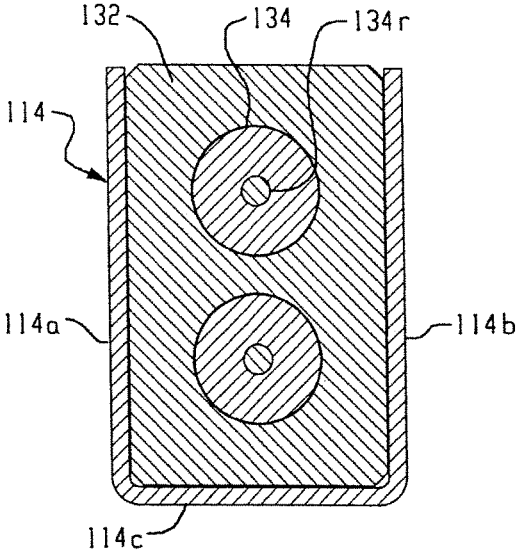
Figure 4:
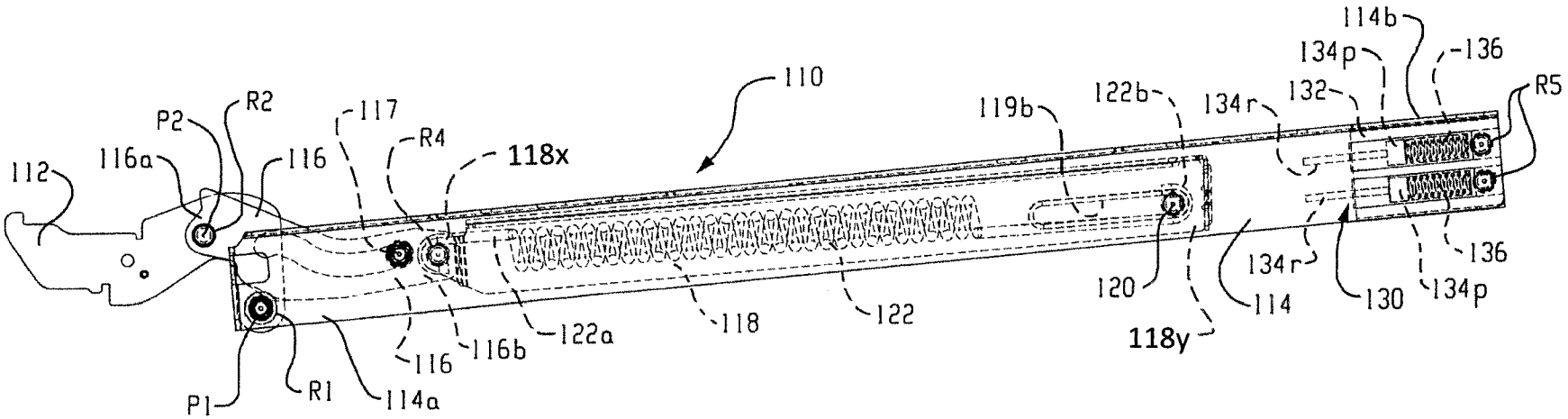
FIG. 4 is a side view that shows the hinge assembly in a second position corresponding to a fully-opened position of the appliance door.
Figure 5:
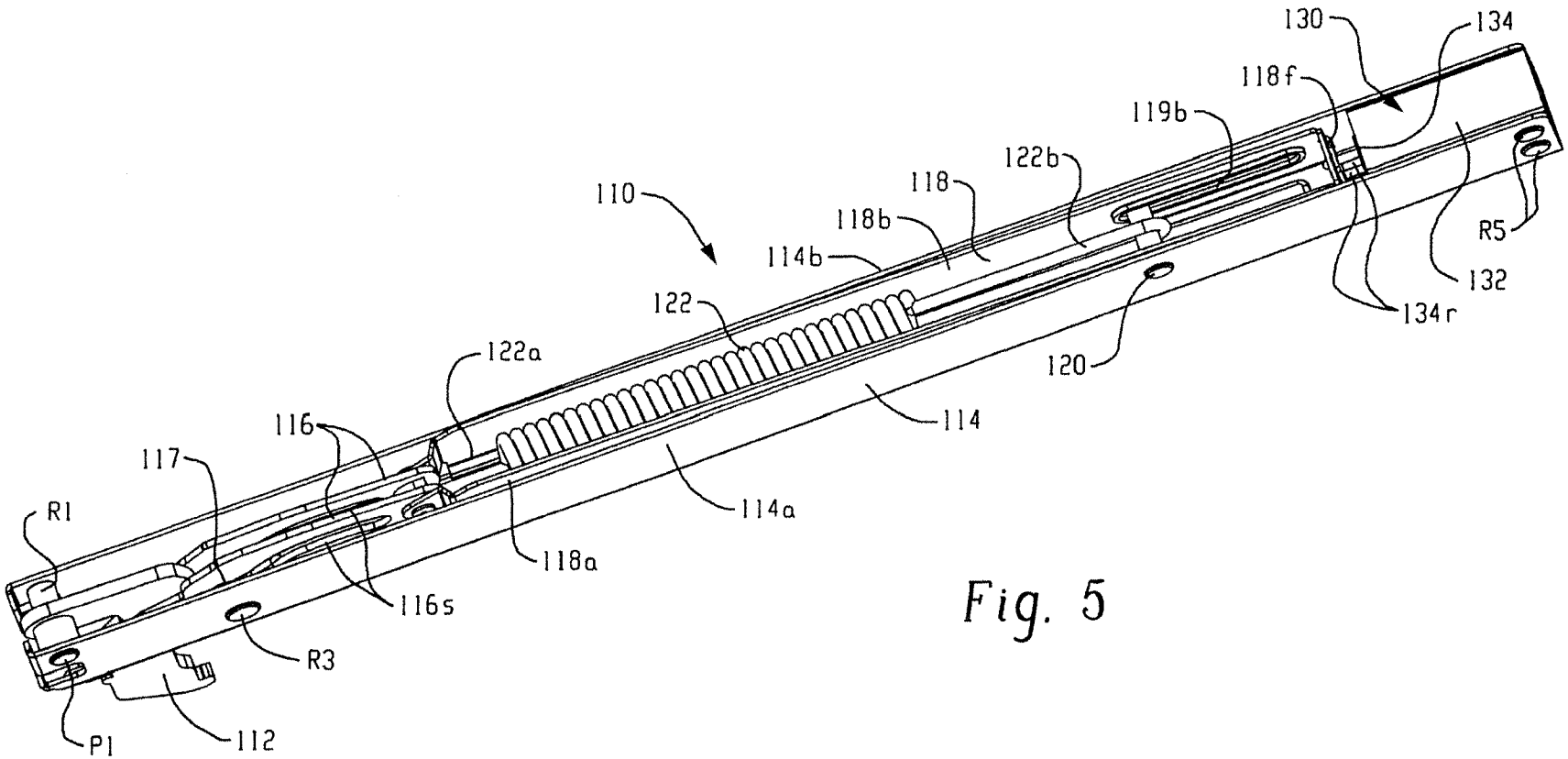
FIGS. 5 and 6 are isometric views of the hinge assembly.
Figure 6:
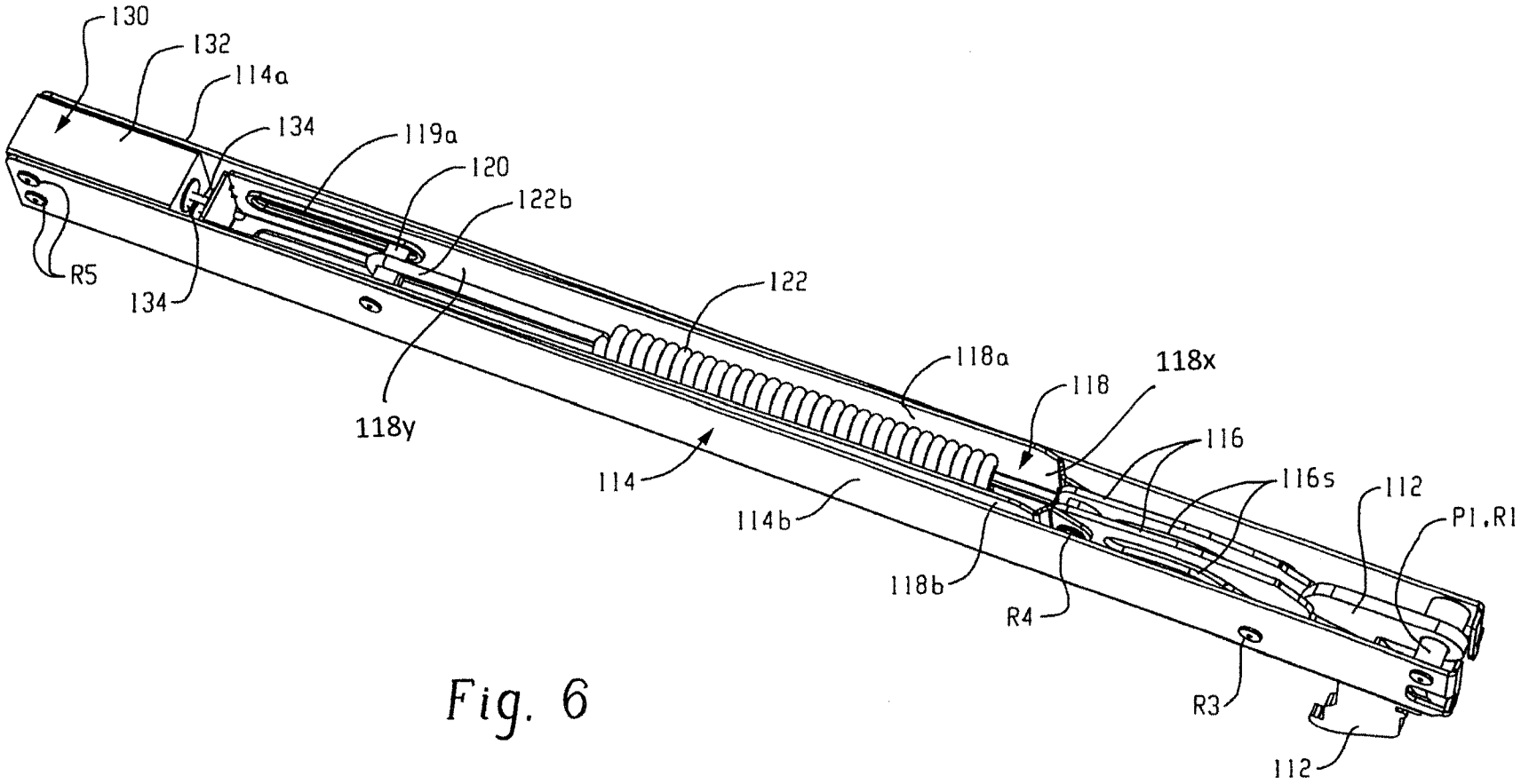
Figure 7:
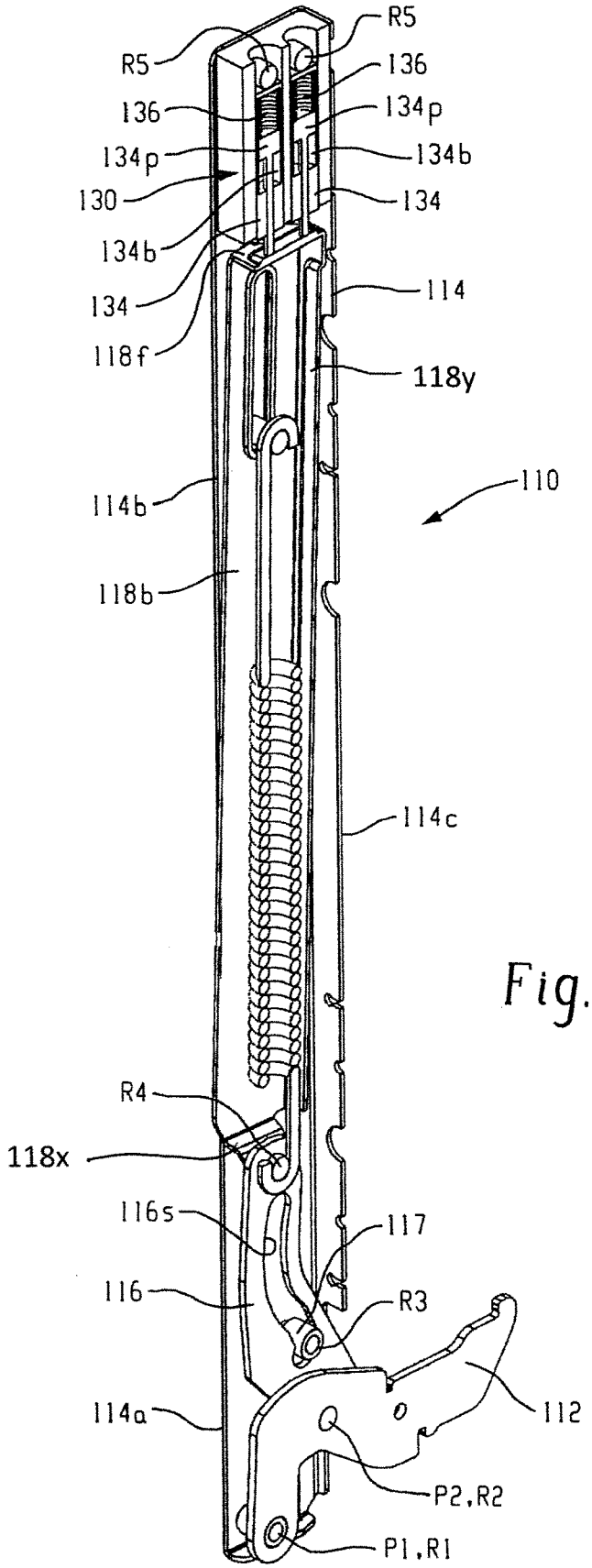
FIG. 7 is a longitudinal section view of the hinge assembly.
Figure 8:
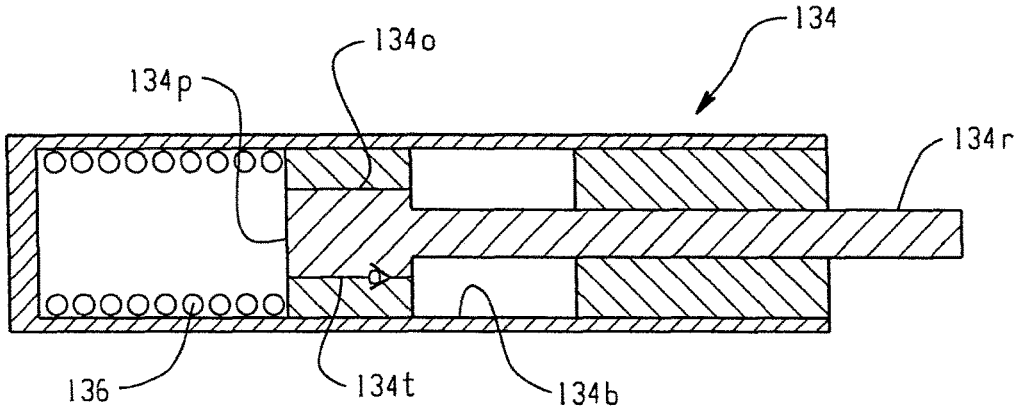
FIG. 8 is a section view of a snubber portion of a snubber assembly/system formed in accordance with one embodiment.
Figure 8A:
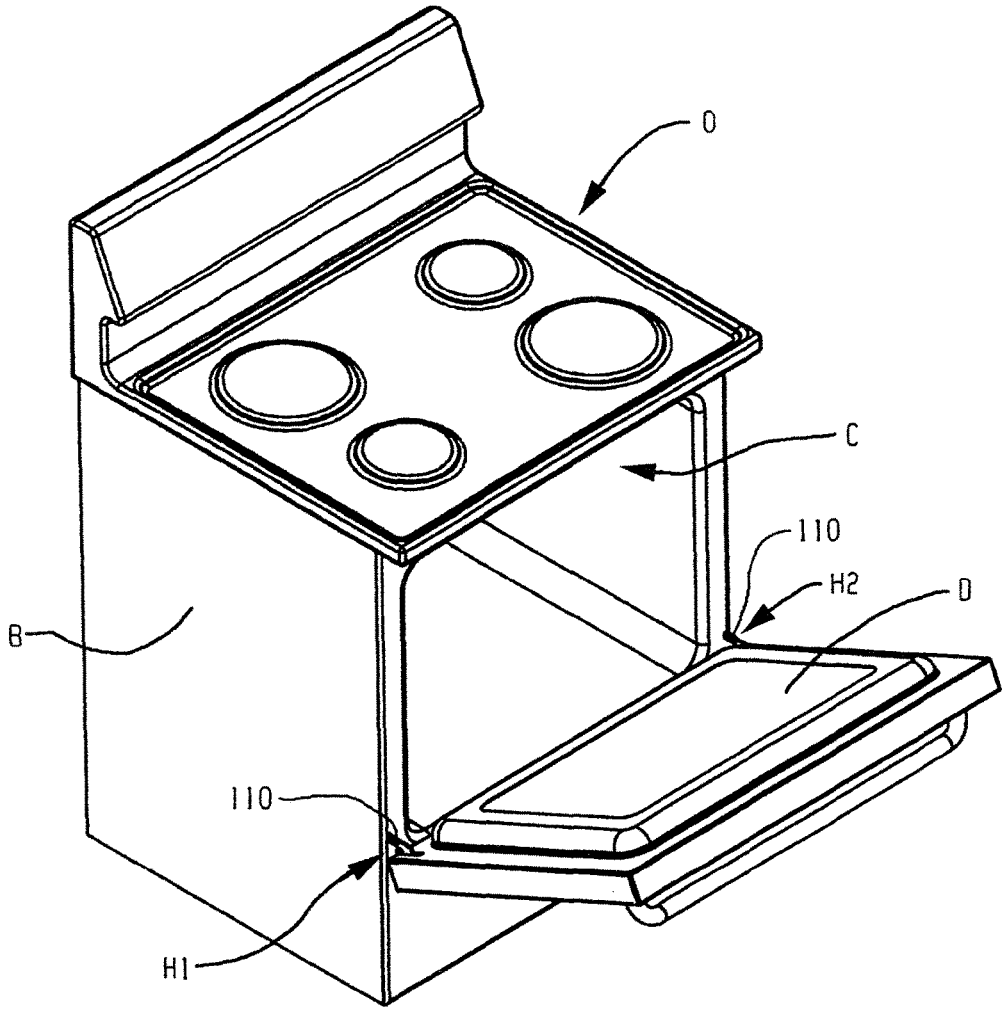
FIG. 8A shows an applicant including at least one hinge assembly according to the present development.

The hinge assembly 110 further comprises a snubber system or snubber subassembly 130 connected to the channel 114 and located in the space S adjacent the second or outer end of the channel 114 such that the slide body 118 is located between the snubber subassembly 130 and the pivot point P1. The snubber subassembly 130 comprises a metal or polymeric snubber base 132 located and anchored in the channel space S. As shown, one or more rivets or other fasteners R5 are used to anchor the snubber base 132 in the channel space S, but the snubber base 132 can otherwise be secured in the channel space S or the base 132 can be defined as part of the channel 114, itself. In the illustrated embodiment, the snubber subassembly 130 comprises at least one and, as shown, a first and an optional second snubber 134 connected to the base 132. With particular reference to FIG. 2 and the section view of the snubber shown in FIG. 8, each snubber 134 comprises a tubular body including a cylindrical bore 134*b* in which a piston 134*p* is slidably disposed. The piston 134*p* comprises a rod 134*r* connected thereto and that projects out of the bore 134*b* away from an inner closed end of the bore 134*b*, and each piston rod 134*r* projects outwardly from the snubber base 132 toward the first pivot point P1. Each piston 134*p* is adapted to reciprocate in its bore 134*b* between an extended position as shown in FIG. 4 where the rod 134*r* projects a maximum distance out of the bore 134*b* and a retracted position (see e.g., FIGS. 2 and 7) in which the piston 134*p* and piston rod 132*r* are urged deeper into the bore 134*b* against a damping resistance so that the rod 134*r* projects outward from the bore 134*b* a lesser distance as compared to the extended position. Each piston 134*p* is biased to its extended position by a spring, a fluid, an elastomeric body, and/or another biasing element or biasing means 136. In the illustrated embodiment, the biasing element comprises a helical coil spring, but the present development is not limited to use of a helical spring. As shown in FIG. 2, each piston 134*p* is movable from its extended position toward its retracted position by external force exerted on the rod 134*r* against the biasing force of the spring or other biasing element 136 and against the damping resistance of a fluid contained in the bore 134*b*.

In use of the hinge assembly 110, the slide body 118 engages the snubber subassembly 130 when the channel 114 is moved from its second (door-opened) position (FIG. 4) toward its first (door-closed) position, before the channel 114 reaches its first (door-closed) position such that the snubber subassembly 130 cushions or dampens movement of the slide body 118 and thus the channel 114 as the channel approaches and moves to its first position in order to prevent a hard closing or "slamming" of the appliance door. In the illustrated embodiment, the slide body 118 comprises a transverse face 118*f* or other structure that engages the projecting piston rods 134*r* of the snubbers 134 of the snubber subassembly 130 when the channel 114 is moved from its second (door-opened) position toward its first (door-closed) position. The transverse face 118*f* of the slide body 118 is separated from the piston rods 134*r* when the hinge assembly is located in its second (door-opened) position. The transverse face 118*f* first contacts the piston rods 134*r* of the snubbers 134 when the channel 114 is moving from its second (door-opened) position toward its first (door-closed) position and reaches the intermediate position shown in FIG. 3, where it can be seen that the piston rods 134*r* are abutted with the slide body transverse face 118*f*. The intermediate position is located between the first (door-closed) position and a position that is between the first (door-closed) and second (door-opened) positions. Further movement of the channel 114 from this intermediate position toward the first (door-closed) position will cause the slide body 118 to move further away from the first pivot point P1 toward the snubber subassembly 130 so as to urge the piston rods 134*r* and their respective pistons 134*p* toward their retracted positions. The slide body 118 maintains continuous contact with the snubbers 134 (i.e., the piston rods 134*r* in the illustrated embodiment) for all locations of the channel 114 between and including said intermediate position and said first position.

In one embodiment, each snubber 134 includes a volume of oil filled in its bore 134*b* to provide the damping resistance. The piston 134*p* is sealingly engaged with the peripheral wall of the bore 134*b* to prevent the flow of oil between the peripheral wall of the bore 134*b* and the piston 134*p*. The piston 134*p* comprises at least one orifice 134*o* or other restricted flow path(s) that allow(s) the oil to flow through or around the piston 134*p* from the inner side of the piston 134*p* (the side of the piston 134*p* oriented toward the biasing element 136) to the opposite outer side of the piston 134*p* (the side of the piston 134*p* oriented away from the biasing element 136). The orifice 134*o* is restricted sufficiently such that a large force is required to move the piston 134*p* inward toward the biasing element 136 as the oil flows through the orifice 134*o*. Preferably, the piston 134*p* is also configured so that the flow of oil is less restricted through the one or more orifices 134*o* (or a different set of one or more orifices such as the return orifice 134*t* incorporating a check valve) in the opposite direction, i.e., from the outer side of the piston 134*p* to the inner side of the piston 134*p* so that the biasing element 136 can return the piston from its retracted position to its extended position with minimal force and in a short time as compared to the force required to move the piston 134*p* from its extended position to its retracted position as diagrammatically shown in FIG. 8.

Figure 3:
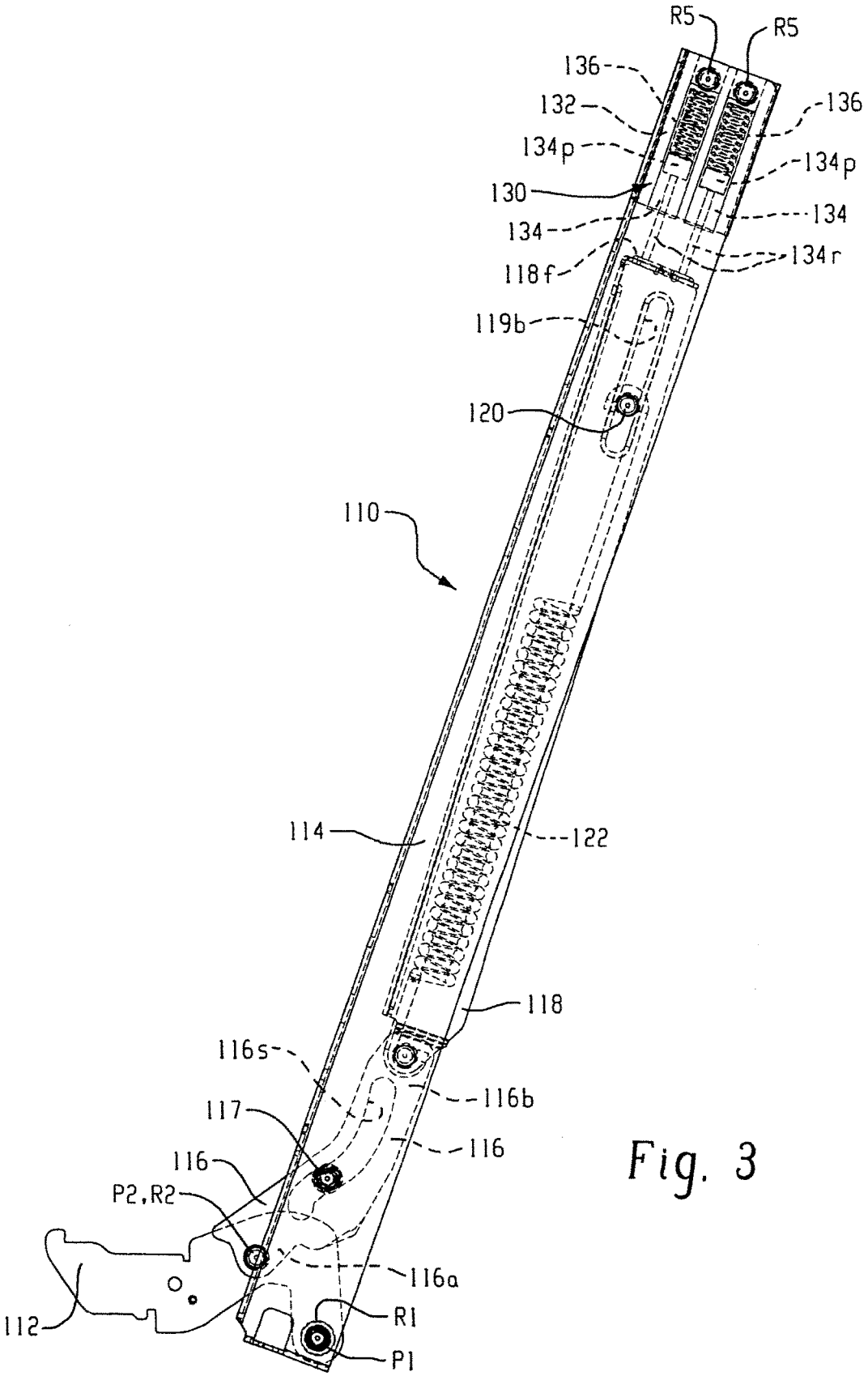
FIG. 3 is a side view that shows the hinge assembly in an intermediate position corresponding to a partially opened position of the appliance door.

The snubber subassembly 130 thus cushions or dampens movement of the slide body 118 away from the pivot point P1 from the intermediate position shown in FIG. 3 to the first (door-closed) position shown in FIG. 2 and correspondingly cushions or dampens movement of the channel 114 as it moves toward its first position so that an appliance door connected to the channel will exhibit a "soft-close" characteristic and will close with less force than if the snubber subassembly 130 was not present, in order to prevent the appliance door from closing with excessive force, speed, or noise. The snubber subassembly 130 also improves the consistency of the speed or rate of closing of the door/lid connected to the channel 114.

In an alternative embodiment, the biasing element 136 is used not only to return the piston 134*p* from its retracted position to its extended position, but also to provide sufficient damping force or resistance that resists movement of the piston 134 into the bore 134*b* from its extended position to its retracted position to cushion or damp movement of the slide body 118 away from the pivot point P1 and correspondingly cushion or damp movement of the channel 114 as it moves toward its first position so that an appliance door connected to the channel will exhibit a "soft-close" characteristic and will close with less force than if the snubber subassembly 130 was not present, in order to prevent the appliance door from closing with excessive force, speed, or noise.

Second Embodiment

Figure 9:
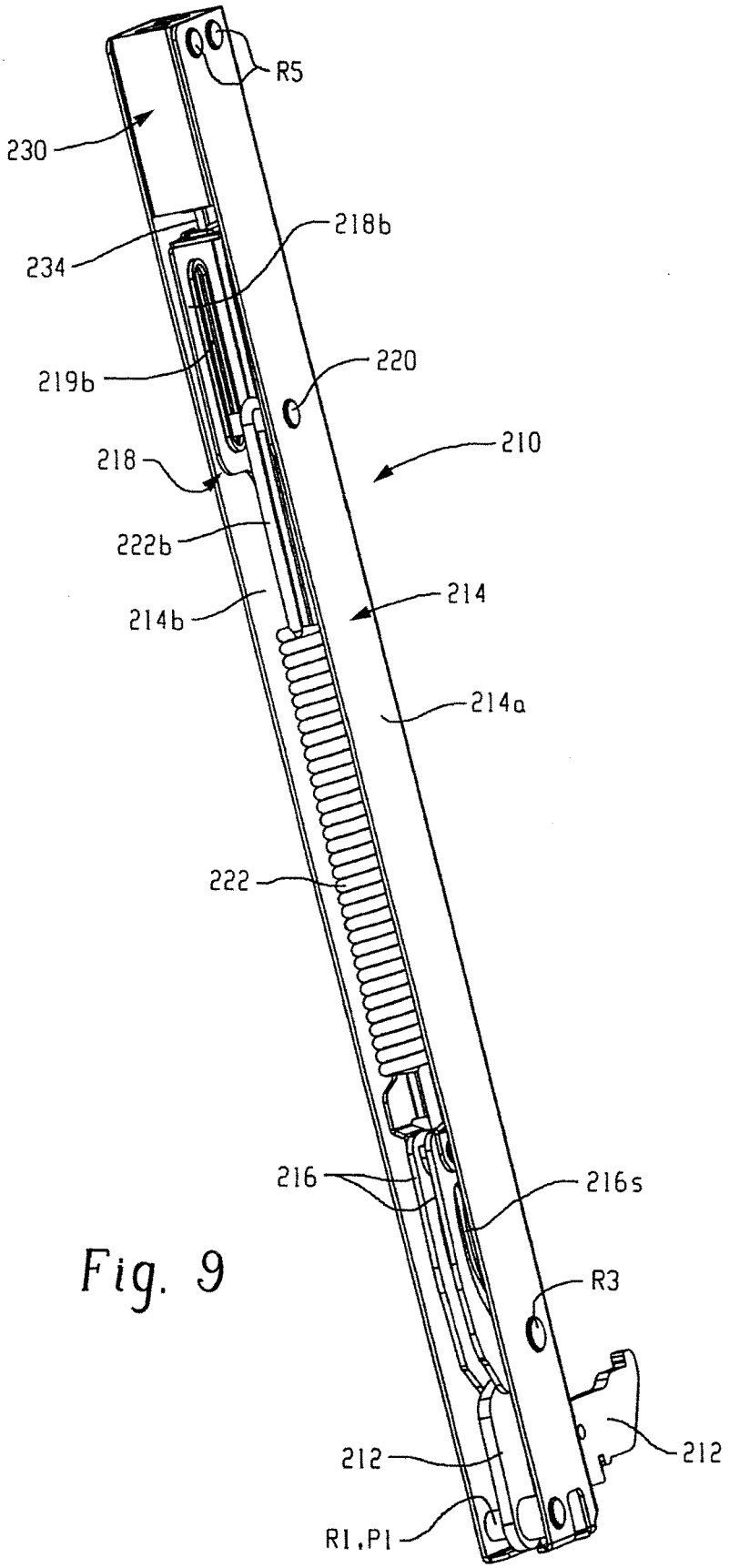
FIG. 9 is an isometric view of a second embodiment of a hinge assembly.
Figure 10:
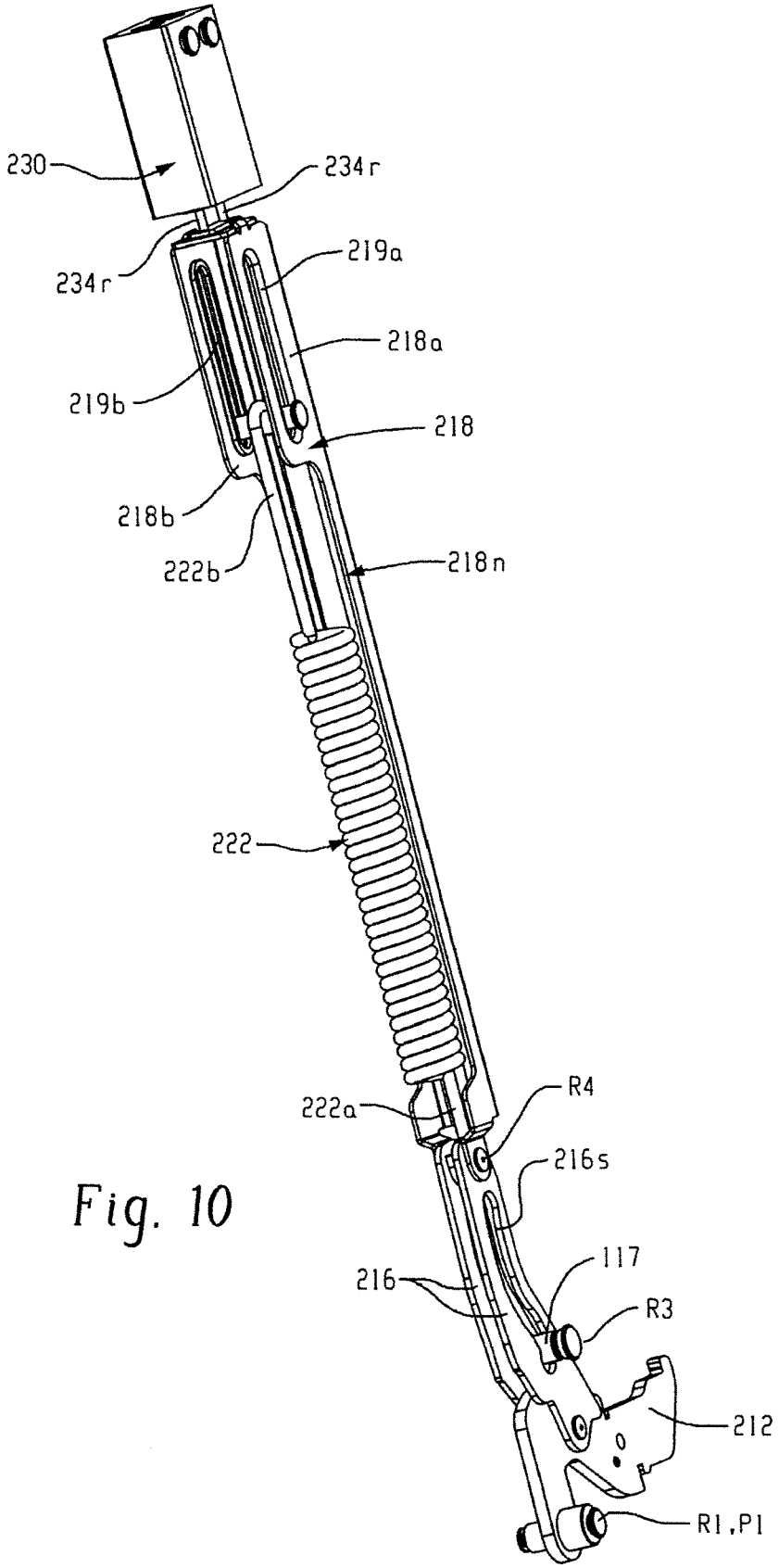
FIG. 10 is similar to FIG. 9 with the channel portion removed to reveal internal components.
Figure 11:
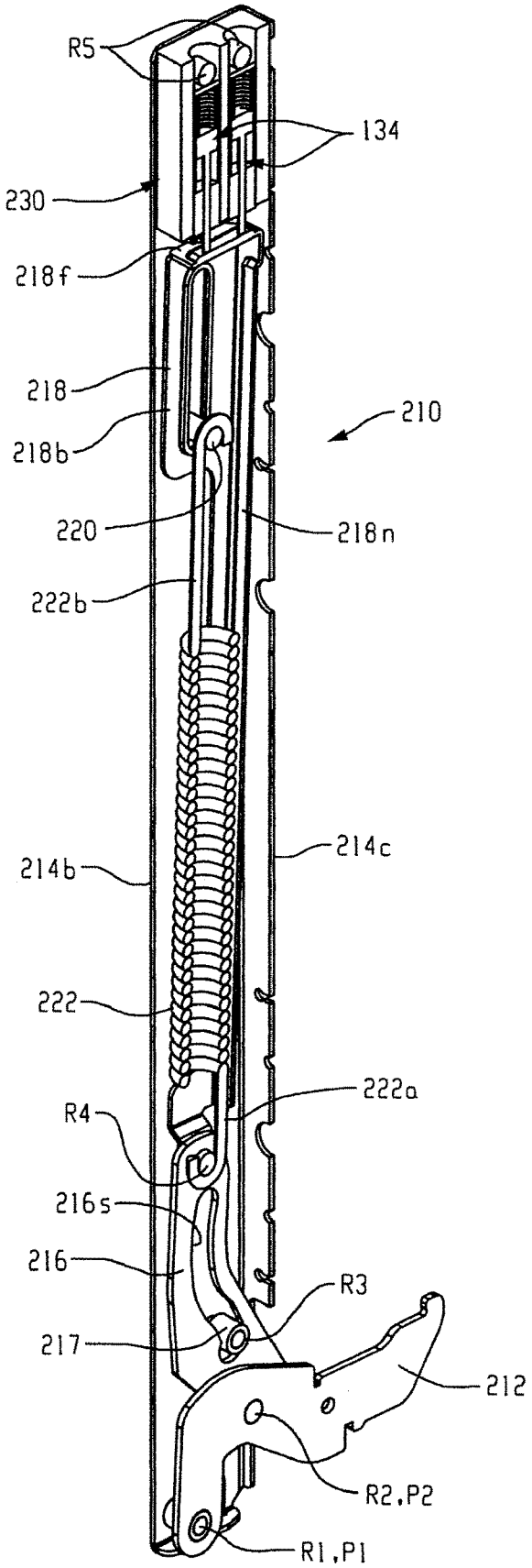
FIG. 11 is a longitudinal section view of the hinge assembly of FIG. 9.

FIGS. 9, 10, and 11 show an alternative embodiment of a soft close hinge assembly 210 formed in accordance with a second embodiment. The hinge assembly 210 is identical to the hinge assembly 110 except as otherwise shown and/or described herein. Like components of the hinge assembly 210 relative to the hinge assembly 110 are shown with corresponding reference numbers that are 100 greater than those used in connection with the hinge assembly 110, and in some cases identical reference characters are used to identify corresponding components relative to the hinge assembly 110.

FIG. 9 provides an isometric view; FIG. 10 is similar to FIG. 9 but the channel 214 has been removed to reveal internal components; and FIG. 11 is a section view. The hinge assembly 210 uses an alternative slide body 218 that is identical to the slide body 118, except that the side walls 118*a*,118*b* of the slide body 118 are removed or notched in the region located between the control links 216 at the inner end and the elongated slots 219 at the outer end to form a notched region 218*n*. This reduces weight, cost, and allows for use of a larger diameter spring 222 that would not be able to fit in the space defined between the side walls 118*a*,118*b* of the slide body 118.

Third Embodiment

FIGS. 12, 13, 14 and 15 show another alternative embodiment of a soft close hinge assembly 310 formed in accordance with a third embodiment. The hinge assembly 310 is identical to the hinge assembly 210 except as otherwise shown and/or described herein. Like components of the hinge assembly 310 relative to the hinge assembly 210 are shown with corresponding reference numbers that are 100 greater than those used in connection with the hinge assembly 210, and in some cases identical reference characters are used to identify corresponding components relative to the hinge assembly 210.

Figure 12:
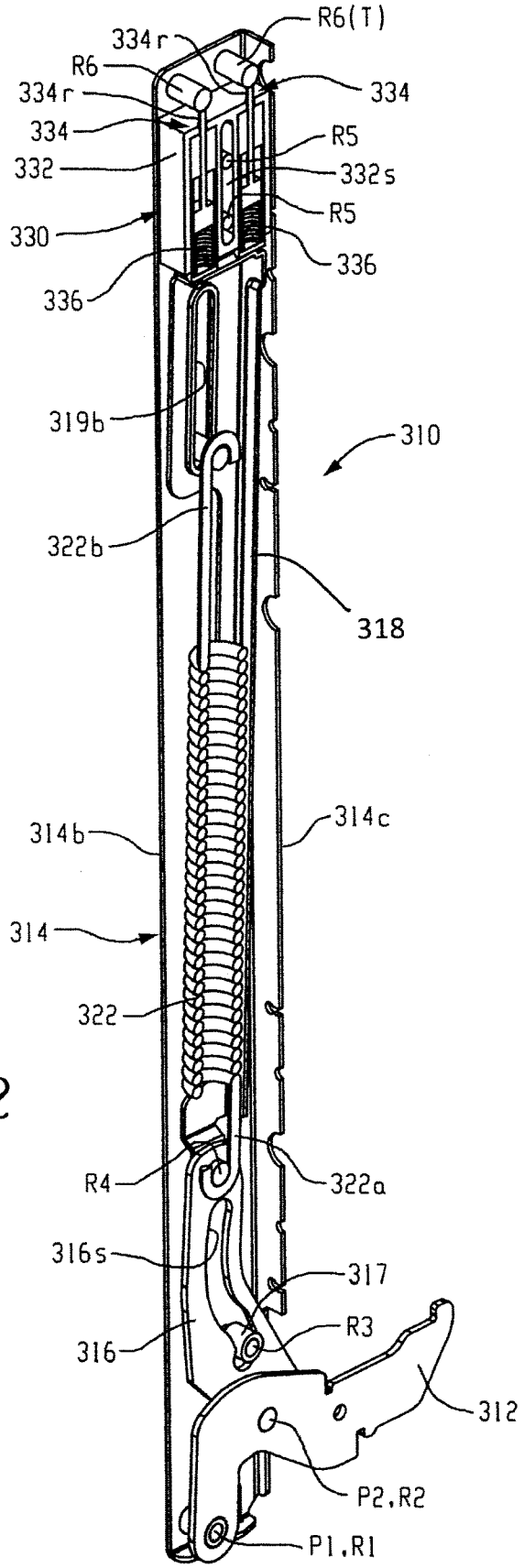
FIG. 12 is similar to FIG. 11 but shows a third embodiment including an alternative snubber system.
Figure 13:
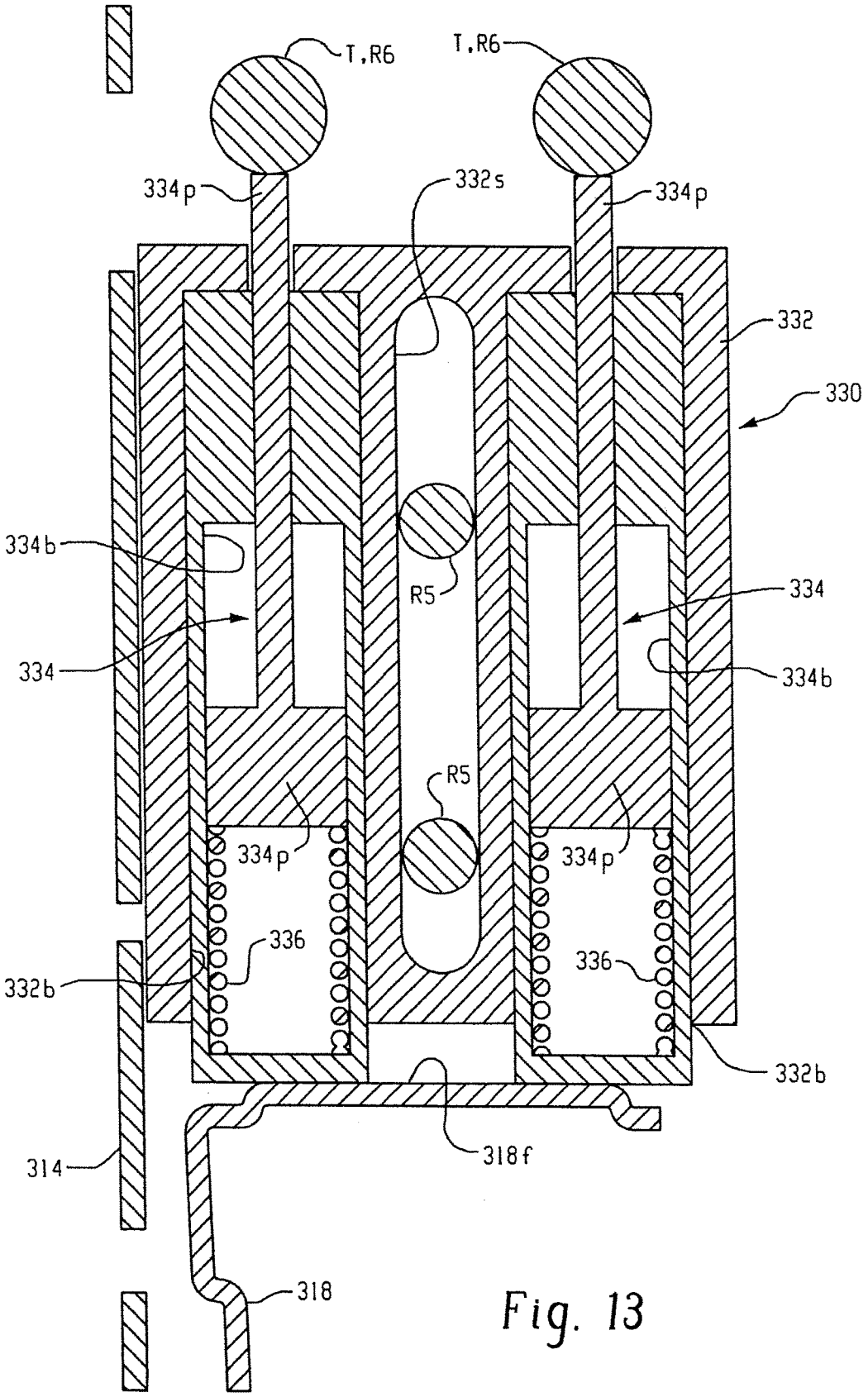
FIG. 13 is an enlarged side section view of the alternative snubber system of FIG. 12.
Figure 14:
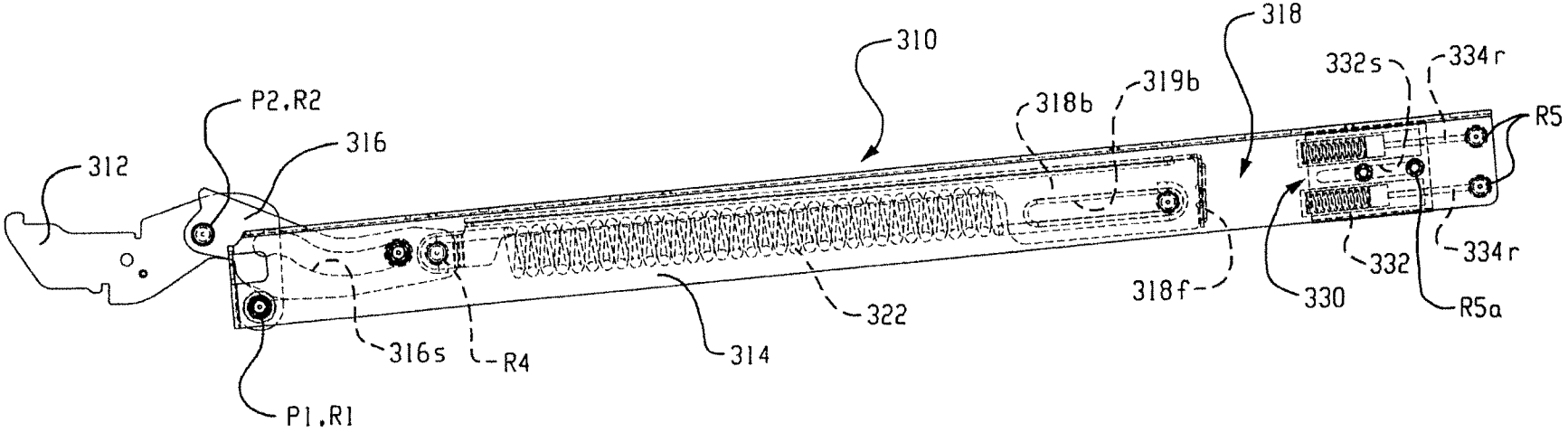
FIG. 14 shows the hinge assembly of FIG. 12 in a position corresponding to an opened position of an associated appliance door.
Figure 15:
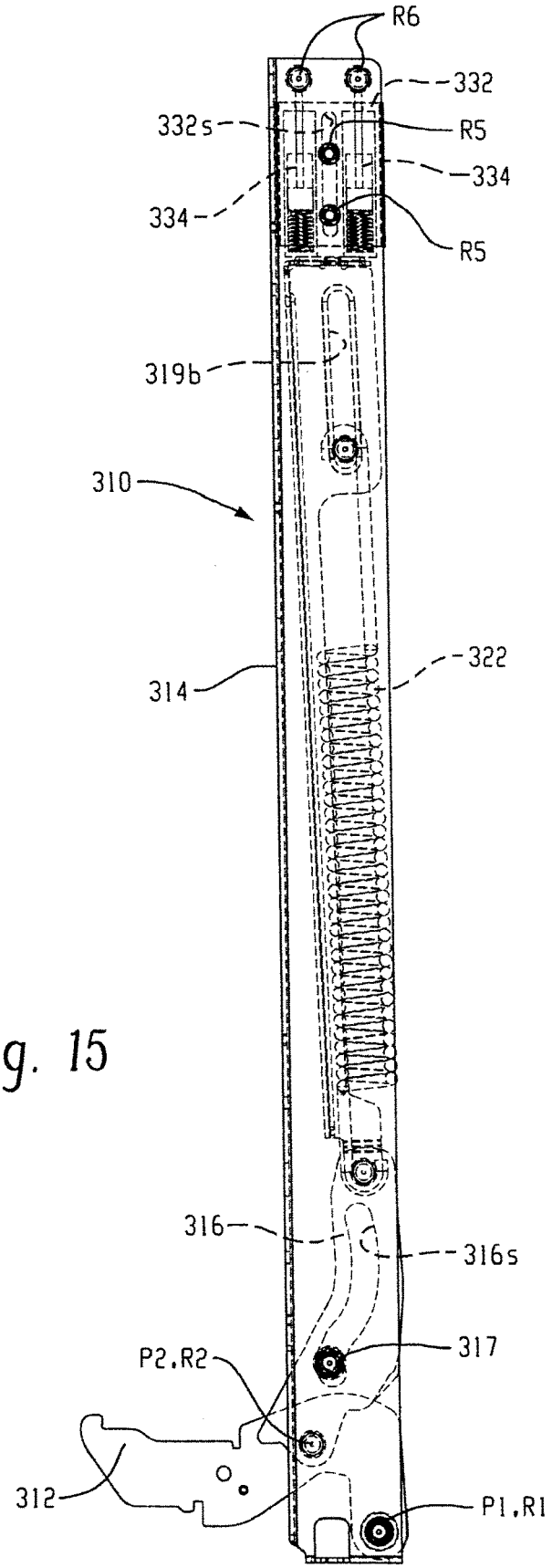
FIG. 15 shows the hinge assembly of FIG. 12 in a position corresponding to a closed position of an associated appliance door.
Figure 16:
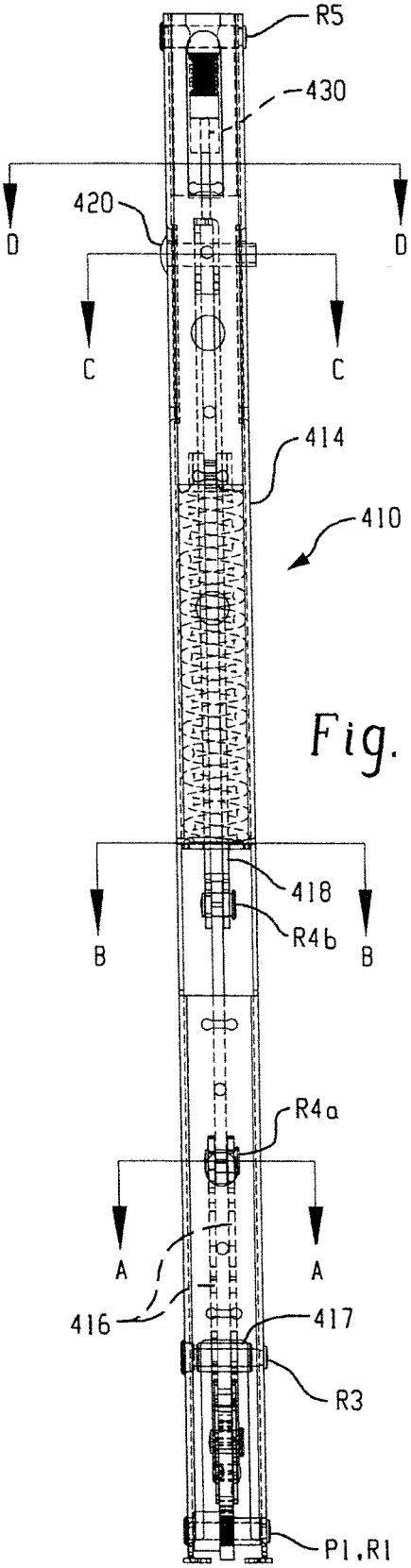
FIGS. 16 and 17 are front and side views that show a hinge assembly in accordance with a fourth embodiment.

FIG. 12 is a section view; FIG. 13 is a greatly enlarged section view of the snubber subassembly 330 and its connection to the channel 318. FIG. 14 shows the hinge assembly 310 in its second (door-opened) position, and FIG. 15 shows the hinge assembly 310 in its first (door-closed) position. As compared to the hinge assembly 210, the hinge assembly 310 differs in that the snubber subassembly 330 is mounted in an opposite orientation, with its snubbers 334 oriented so that the piston rods 334*r* projects outwardly away from the pivot point P1. Additionally, the snubber base 332 is slidably connected to the channel 314 in the space S. First and second stop rivets R6 or other stop structures T are connected to or provided by part(s) of the channel 314 and provide a stop or reaction surface against which the piston rods 334*p* bear. The snubber base 332 includes a mounting slot 332*s* that extends parallel to the piston rods 334*p* and parallel to the longitudinal axis of the channel 314, and one or more mounting rivets R5 or other mounting fasteners are connected to and extend between the first and second channel side walls 314*a*,314*b* and through the mounting slot 332*s* to capture the snubber base 332 in the space S and slidably connect the snubber base 332 to the channel 314, while allowing the snubber base 332 to slide in a reciprocal manner along a limited length path in the space S toward and away from the pivot point P1 during use of the hinge assembly 310.

FIG. 13 shows the transverse face 118*f* of the slide body 318 abutted with the snubber subassembly 330 (abutted with the parts of the snubbers 334 that extend from the snubber base 332 and/or with the base 332 itself) such that the slide body 318 urges the snubber base 332 away from the pivot point P1 against the biasing force and damping action provided by the springs 336 of the snubbers 334. During movement of the channel 314 from its second (door-opened) position of FIG. 14 toward its first (door-closed) position of FIGS. 12, 13, 15, the slide body 318 must move the snubber base 332 outward relative to the first pivot point P1 from a free or home position (shown in FIG. 14), where the snubber base 332 is spaced from the stop rivets R6 a maximum distance as limited by contact between the outermost mounting rivet R5*a* and the outer end of the mounting slot 332*s*, to an engaged position (FIGS. 12, 13, 15), where snubber base 332 is moved away from the pivot point P1 and toward the stop rivets R6 against the biasing force of the snubbers 334 while the piston rods 334*r* bear against the stop rivets R6. In particular, outward movement of the slide body 318 during movement of the channel 314 from its second position to its first position causes the transverse face 318*f* of the slide body 318 to abut the snubber base 332 and/or one or more components connected to the snubber base 332 so that the slide body 318 urges the snubber base 332 outward toward its engaged position, which causes the pistons 334*p* to be urged inward toward their retracted positions against the damping resistance of the oil or fluid contained in the snubber bore 334*b* and the biasing force of the snubber springs 336 due to contact between the piston rods 334*r* and the stop rivets R6. This movement of the pistons 334*p* toward their retracted positions against the damping resistance of the oil or other fluid contained in the snubber bore 334*b* acts to dampen outward movement of the slide body 318 and the snubber base 332.

Conversely, when the slide body 318 moves toward the pivot point P1 and away from the stop rivets R6 during movement of the channel 314 toward its second (door-opened) position, the snubbers 334 urge the snubber body 332 back toward its free or home position. The snubber base 332 can be defined from a molded polymeric or other suitable material. FIG. 13 also shows that the snubbers 334 are each self-contained units that are located in a respective mounting opening or bore 332*b* of the snubber base 332, which is also one preferred construction for other snubber subassembly embodiments 130, 230, 430, 530 disclosed herein. This embodiment provides additional support for the snubbers 334 and prevents side loads from being exerted thereon which can negatively affect their performance and durability.

Fourth Embodiment

FIGS. 16-21 show another alternative embodiment of a hinge assembly 410. The hinge assembly 410 is identical to the hinge assembly 110 except as otherwise shown and/or described herein. Like components of the hinge assembly 410 relative to the hinge assembly 110 are shown with corresponding reference numbers that are 300 greater than those used in connection with the hinge assembly 110, and in some cases identical reference characters are used to identify corresponding components relative to the hinge assembly 110. FIGS. 16A, 16B, 16C, and 16D are section views as taken at A-A, B-B, C-C and D-D of FIG. 16, respectively.

A primary difference between the hinge assembly 110 and the hinge assembly 410 is that the tension spring 122 of the hinge assembly 110 has been replaced by a helical compression spring 422, and the slide body is provided in the form of a spring rod 418 that extends coaxially through the open core of the compression spring 422. The outer end of the spring rod 418 that is spaced a from the pivot point P1 includes or defines a transverse structure or face 418*f* adapted to engage the piston rods 434*r* of the snubber subassembly 430 in the same manner as described above in relation to the transverse face 118*f* and its engagement with the piston rods 134*p* of the snubber subassembly 130. In the illustrated embodiment, snubber subassembly 430 is structured and operates identically to the snubber subassembly 130.

The spring rod 418 is connected to the control link(s) 416 by a connector link 418L (or a series of pivotally connected connector links 418L). The connector link 418L can be provided by multiple parallel link members. The inner end of the connector link 418L (the end closest to the first pivot point P1) is pivotally connected to the outer end of the control link(s) 416 by a rivet or other fastener R4*a*, and the opposite outer end of the connector link 418L is pivotally connected to the inner end of the spring rod 418 by a rivet or other fastener R4*b*. Pivoting movement of the channel 414 between its first and second positions causes linear reciprocal sliding movement of the spring rod 418 in the channel space S. The outer end of the spring rod 418 is slidably connected to the channel 414 and captured in the space S by a slide rivet or other slide fastener 420 that extends through both elongated slots 419*a*,419*b* respectively defined in the first and second channel side walls 414*a*,414*b* and through the outer end of the spring rod 418 (see also FIG. 16C). As with all above embodiments, the slide fastener 420 can be replaced by any other suitable structure connected to or formed as part of the slide body 418 and slidably captured in one or more elongated slots defined in the channel.

The spring 422 is coaxially positioned around the spring rod 418. The channel 414 comprises a fixed spring support wall 423 connected thereto or defined as part thereof and located in the space between the pivot point P1 and the elongated slide wall slots 419*a*,419*b*. In the illustrated embodiment, the fixed spring support wall 423 is provided by a tab or like projection of the channel front wall 414*c* that is formed so as to lie transverse to the spring rod 418. The spring rod 418 passes through an aperture or other opening the spring support wall 423. A lower or inner end 422*a* of the spring 422 is abutted with the spring support wall 423. The spring rod 418 includes or defines a radially projecting tab or like spring-engagement structure 424 that is fixed in position thereon, and the outer end 422*b* of the spring 422 is abutted or lies closely adjacent the spring spring-engagement structure 424. As such, inward sliding movement of the spring rod 418 during door opening causes the spring-engagement structure 424 to compress the spring between the spring-engagement structure 424 and the spring support wall 423. Conversely, during door closing, the spring rod 418 moves away from the pivot point P1 and the spring 422 is allowed to elongate resiliently between the fixed spring support 423 and the spring-engagement structure 424 and the spring biases the spring rod 418 away from the pivot point P1.

Figure 17:
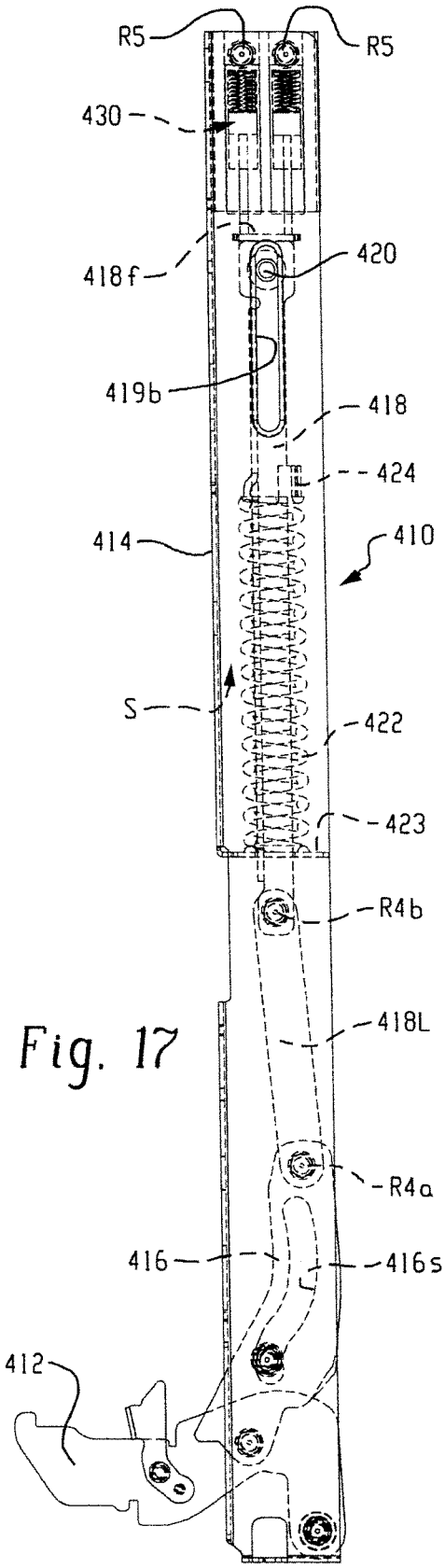
Figure 16A:
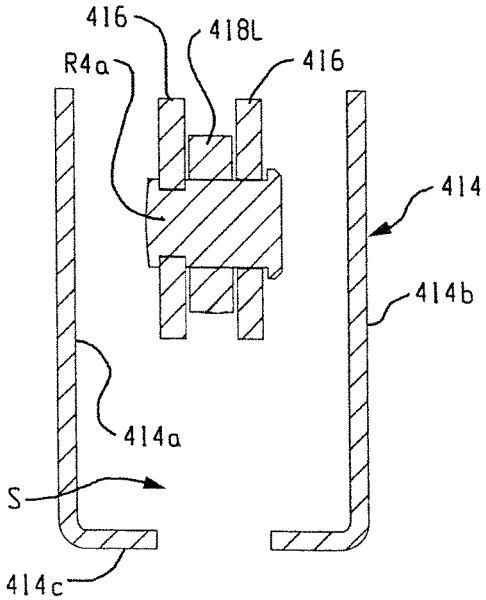
FIGS. 16A, 16B, 16C and 16D are section views taken respectively at lines A-A, B-B, C-C and D-D of FIG. 16.
Figure 16C:
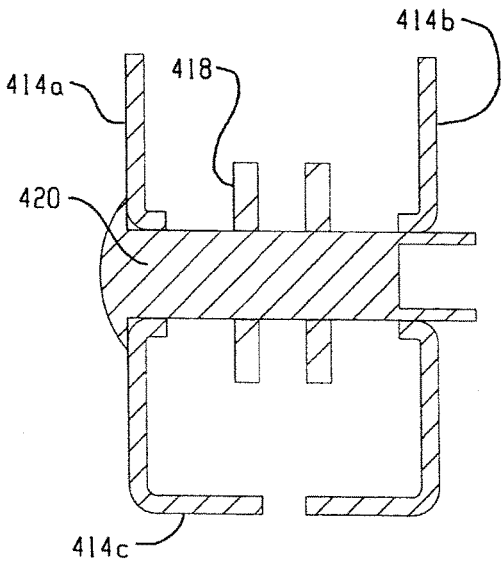
Figure 16B:
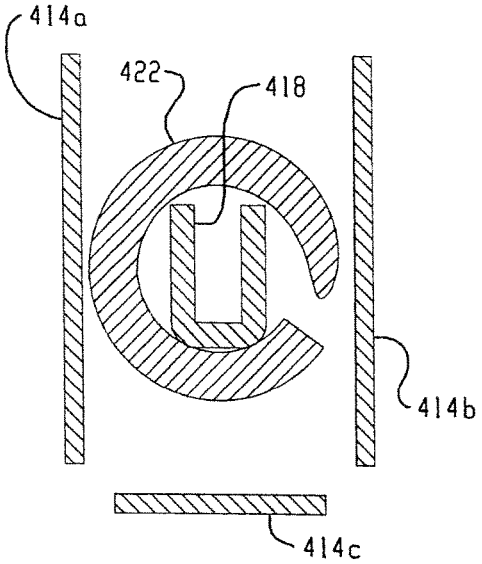
Figure 16D:
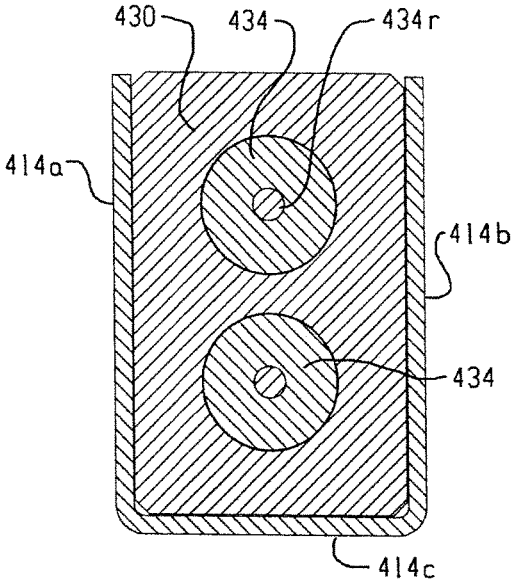
Figure 18:
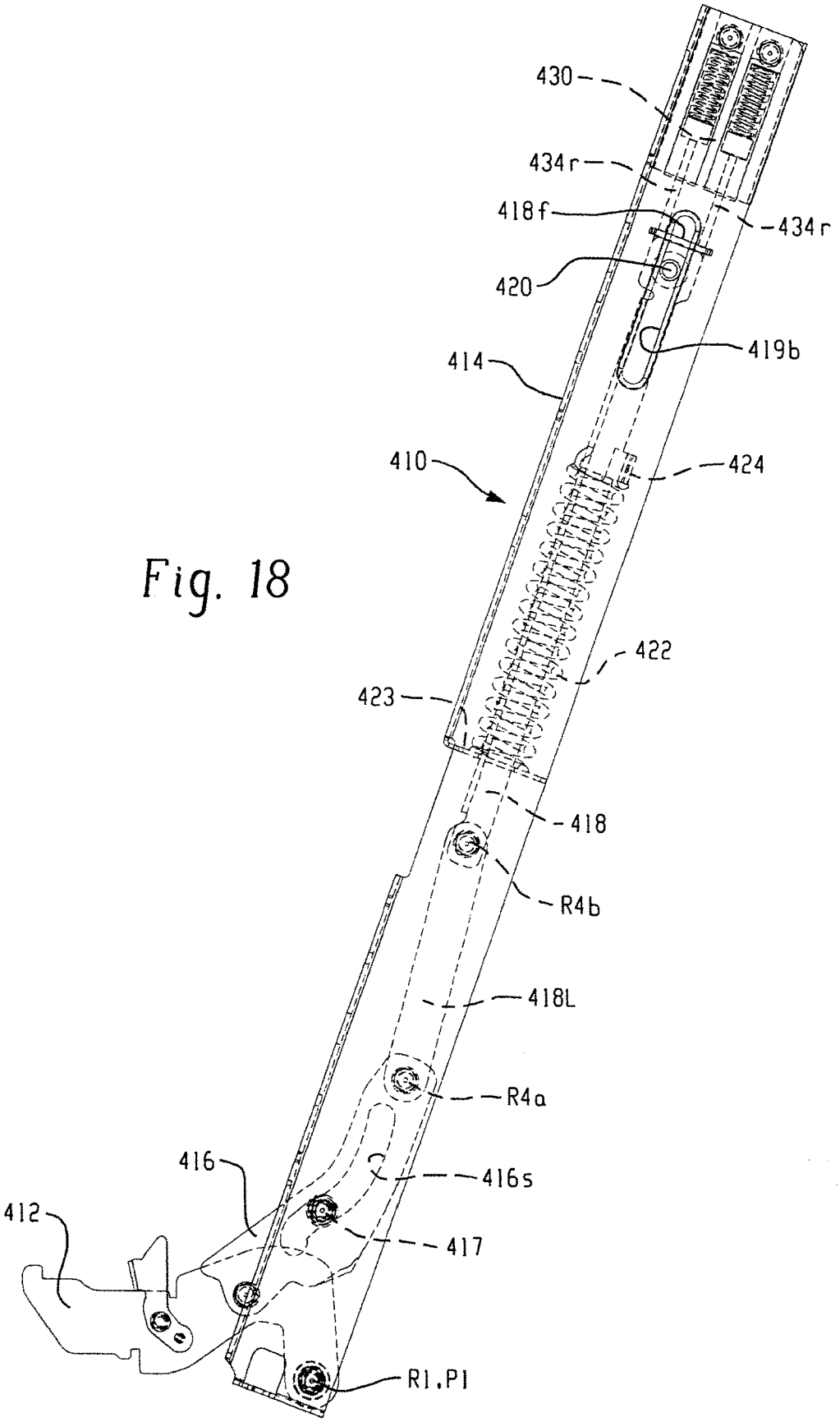
FIG. 18 is a side view that shows the hinge assembly of FIG. 16 in an intermediate position corresponding to a partially opened position of the appliance door.
Figure 19:
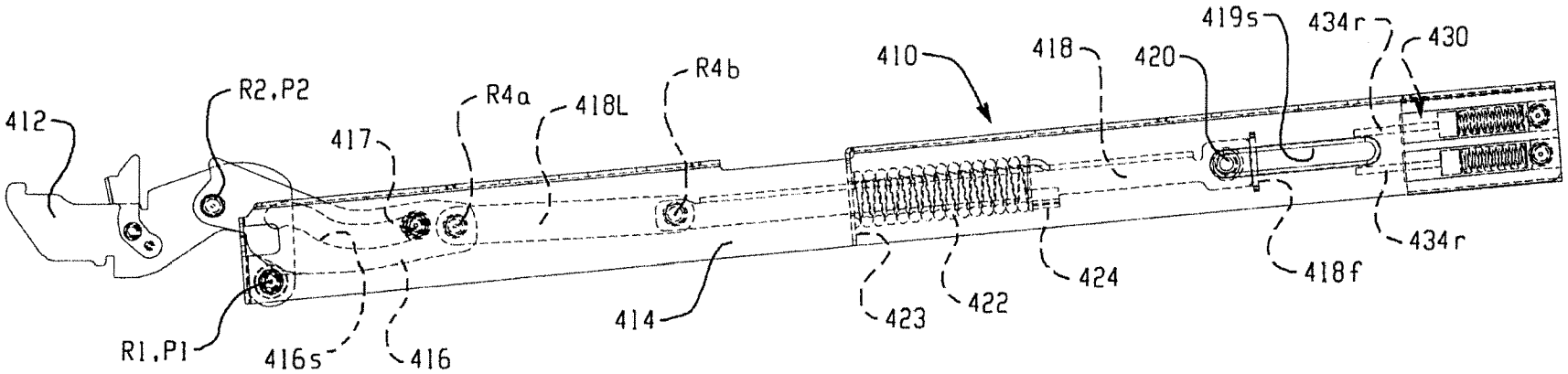
FIG. 19 is a side view that shows the hinge assembly of FIG. 16 in a second position corresponding to a fully-opened position of the appliance door.
Figure 20:
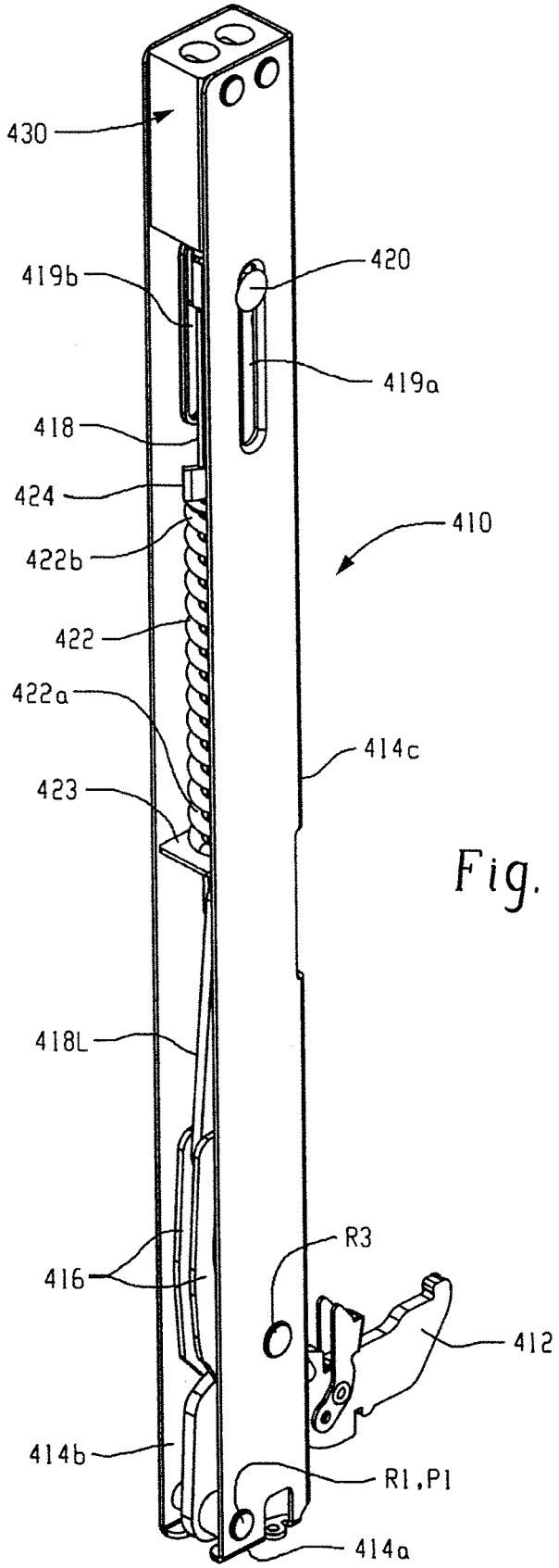
FIG. 20 is an isometric view of the hinge assembly of FIG. 16.
Figure 21:
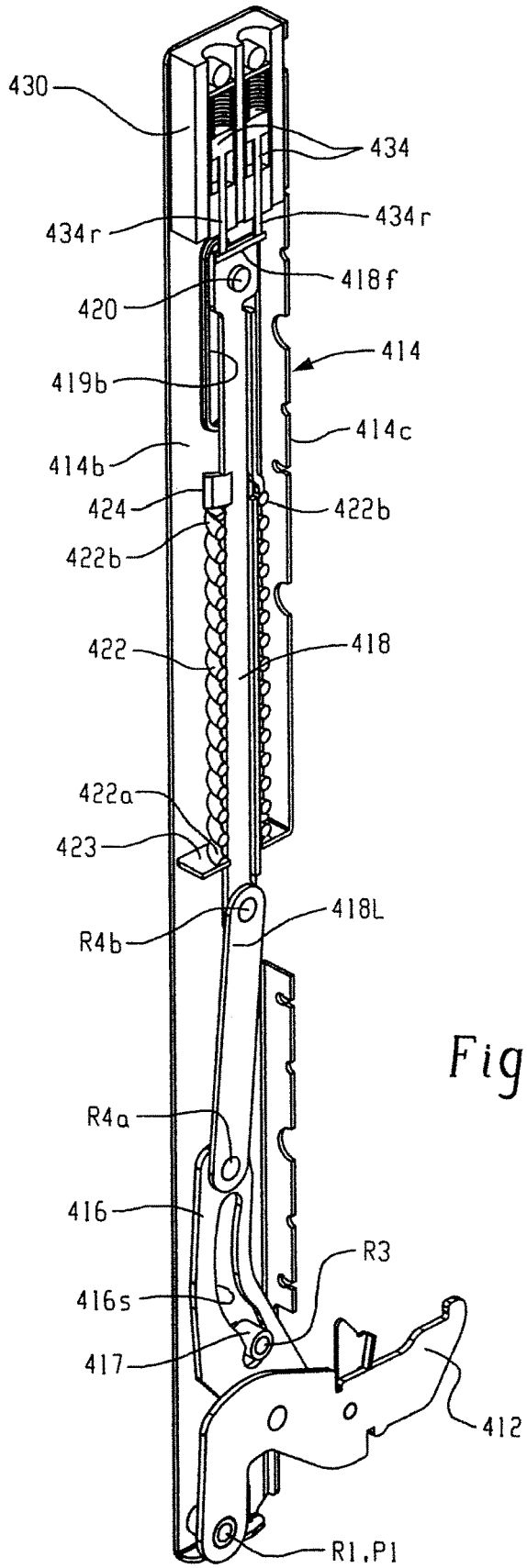
FIG. 21 is a longitudinal section view of the hinge assembly of FIG. 16.
Figure 23:
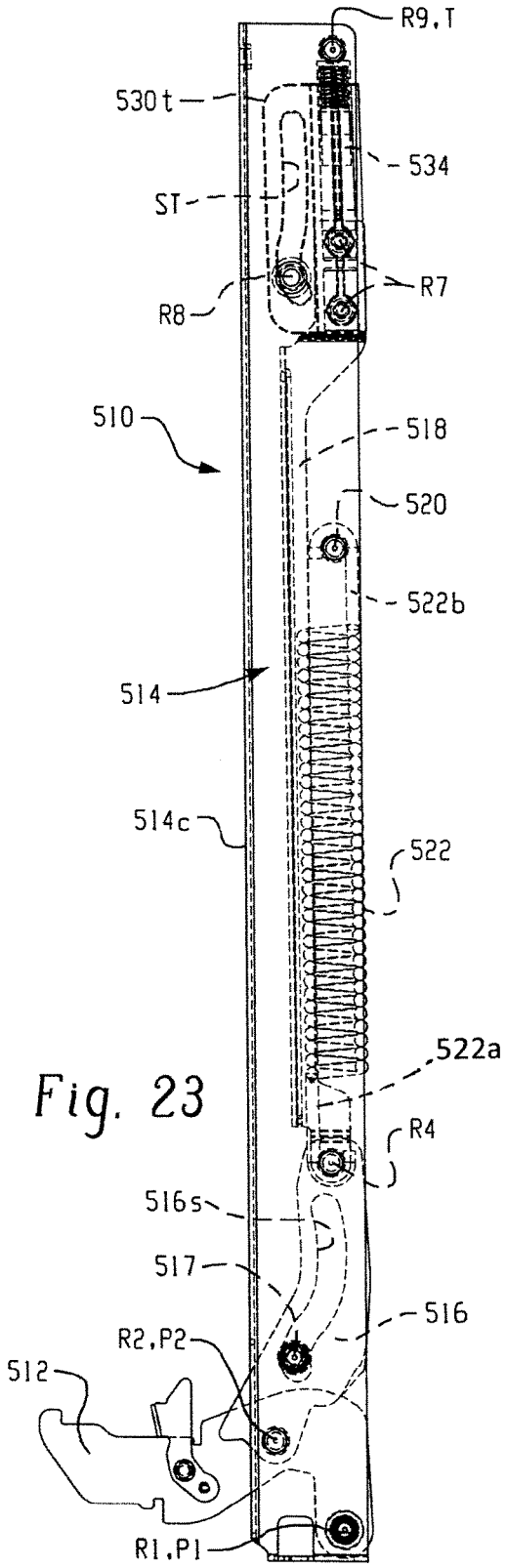

The snubber subassembly 430 operates in the same manner as the snubber subassembly 130 of the embodiment 110 to dampen movement of the channel 414 as the channel moves from its second (door-opened) position as shown in FIG. 19 to its first (door-closed) position as shown in FIG. 17 by abutment of the transverse face 418*f* with the one or more snubbers 434 of the snubber subassembly 430 beginning when the channel 414 reaches the intermediate position shown in FIG. 18.

Fifth Embodiment

FIGS. 22-26 show another alternative embodiment of a hinge assembly 510. The hinge assembly 510 is identical to the hinge assembly 110 except as otherwise shown and/or described herein. Like components of the hinge assembly 510 relative to the hinge assembly 110 are shown with corresponding reference numbers that are 400 greater than those used in connection with the hinge assembly 110, and in some cases identical reference characters are used to identify corresponding components relative to the hinge assembly 110. FIGS. 22A, 22B, 22C, 22D, and 22E are section views as taken at A-A, B-B, C-C, D-D, and E-E of FIG. 22, respectively.

Figure 24:
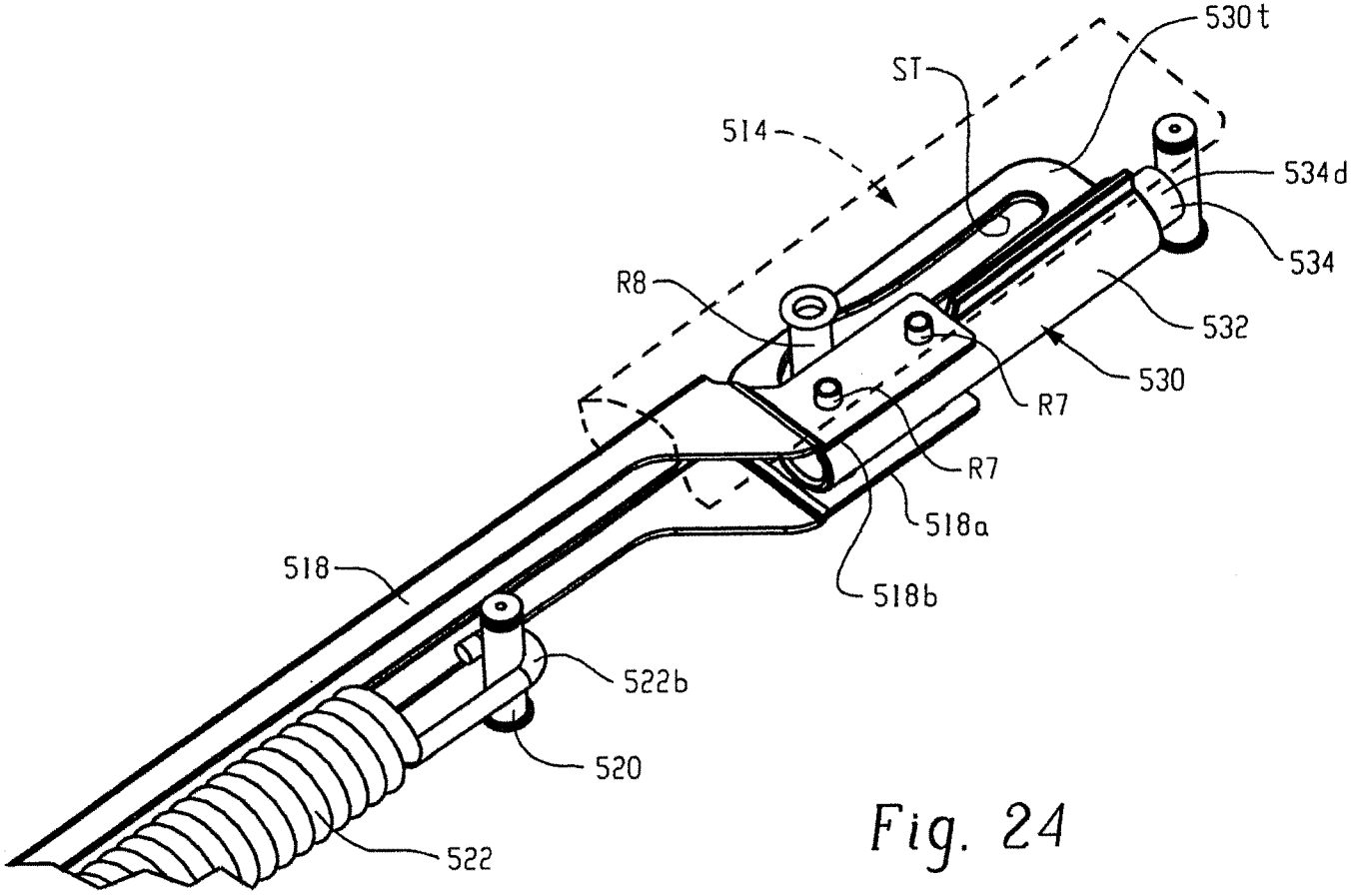
FIG. 24 is a partial isometric view of a portion of the hinge assembly of FIG. 22.

The hinge assembly 510 differs from the above embodiments in that the snubber subassembly 530 is fixedly secured to the outer end of the slide body 518 using one or more mounting fasteners such as rivets R7 or other means as best seen in FIG. 24 (the channel 514 is only partially shown in broken lines in FIG. 24 to better show the snubber subassembly 530 and its connection to the slide body 518). In the illustrated embodiment, the snubber base 532 of the snubber subassembly 530 is secured in the space between the slide body side walls 518*a*,518*b* by the mounting rivet(s) R7 so that the snubber subassembly 530 moves with the slide body 518 as it reciprocates in the channel space S. The snubber base 532 comprises an elongated and contoured snubber slot ST that is defined in a projecting tab or ear 530*t* that is connected to and/or formed as part of the snubber base 530. A rivet, pin, or other guide member or other like guide fastener R8 is connected to and extends between the channel side walls 414*a*,414*b* and extends through the space S and through the contoured snubber slot ST so as to slidably capture and control the movement of the snubber base 532 and the outer end of the slide body 518 in the channel space S. The presence of slot ST eliminates the need for the slide body 518 to include elongated slots (such as the slots 119*a*,119*b*) in which the rivet 520 is received, although the slide body 518 can alternatively include such slots in which the rivet 520 is located. The spring 522 is connected between the control links 516 at its first end 522*a* (e.g., by engagement with the rivet R4) and the channel 514 at its second end 522*b* (e.g., by engagement with the rivet 520 that extends between the side walls 514*a*,514*b*) and biases the hinge assembly 510 to its first (door-closed position).

Figure 22:
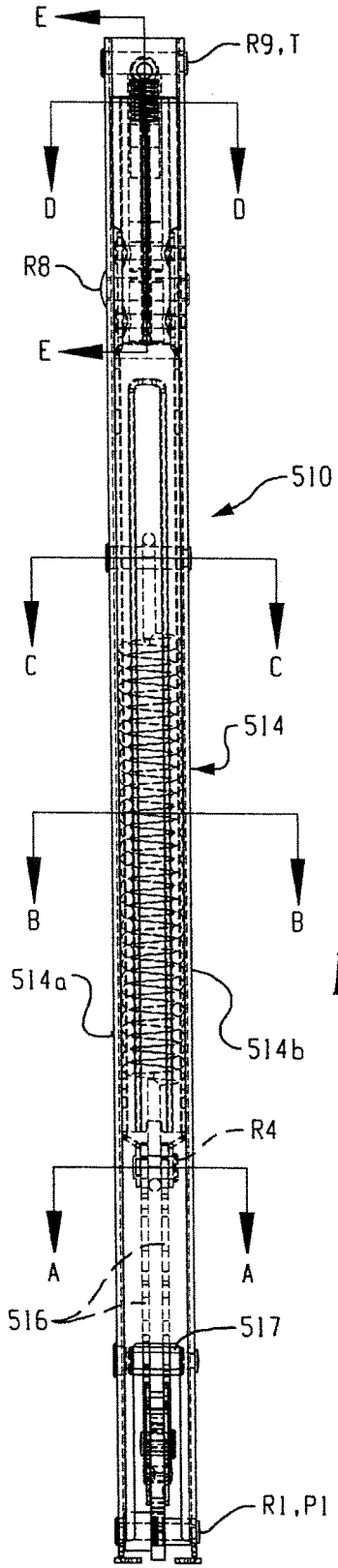
FIGS. 22 and 23 are front and side views that show a hinge assembly in accordance with a fifth embodiment.
Figure 22A:
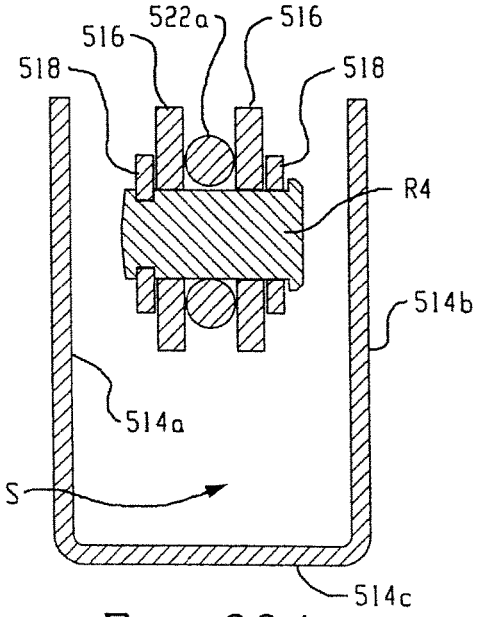
FIGS. 22A, 22B, 22C and 22D are section views taken respectively at lines A-A, B-B, C-C and D-D of FIG. 22.
Figure 22C:
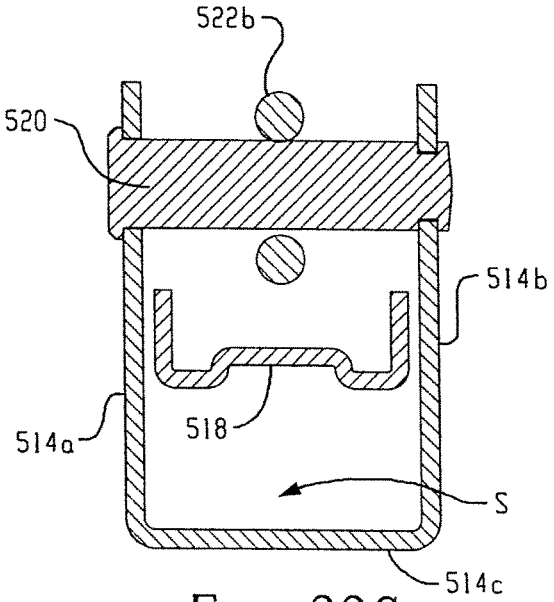
Figure 22B:
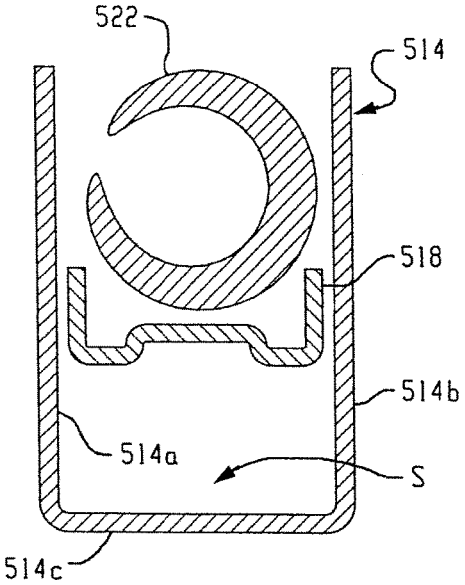
Figure 22D:
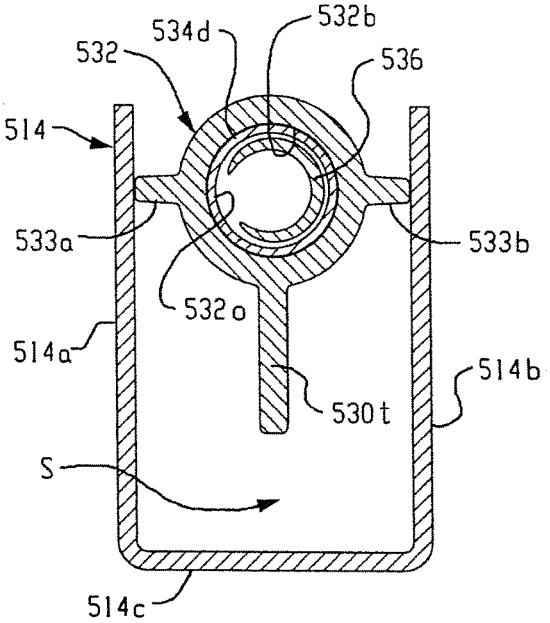
Figure 22E:
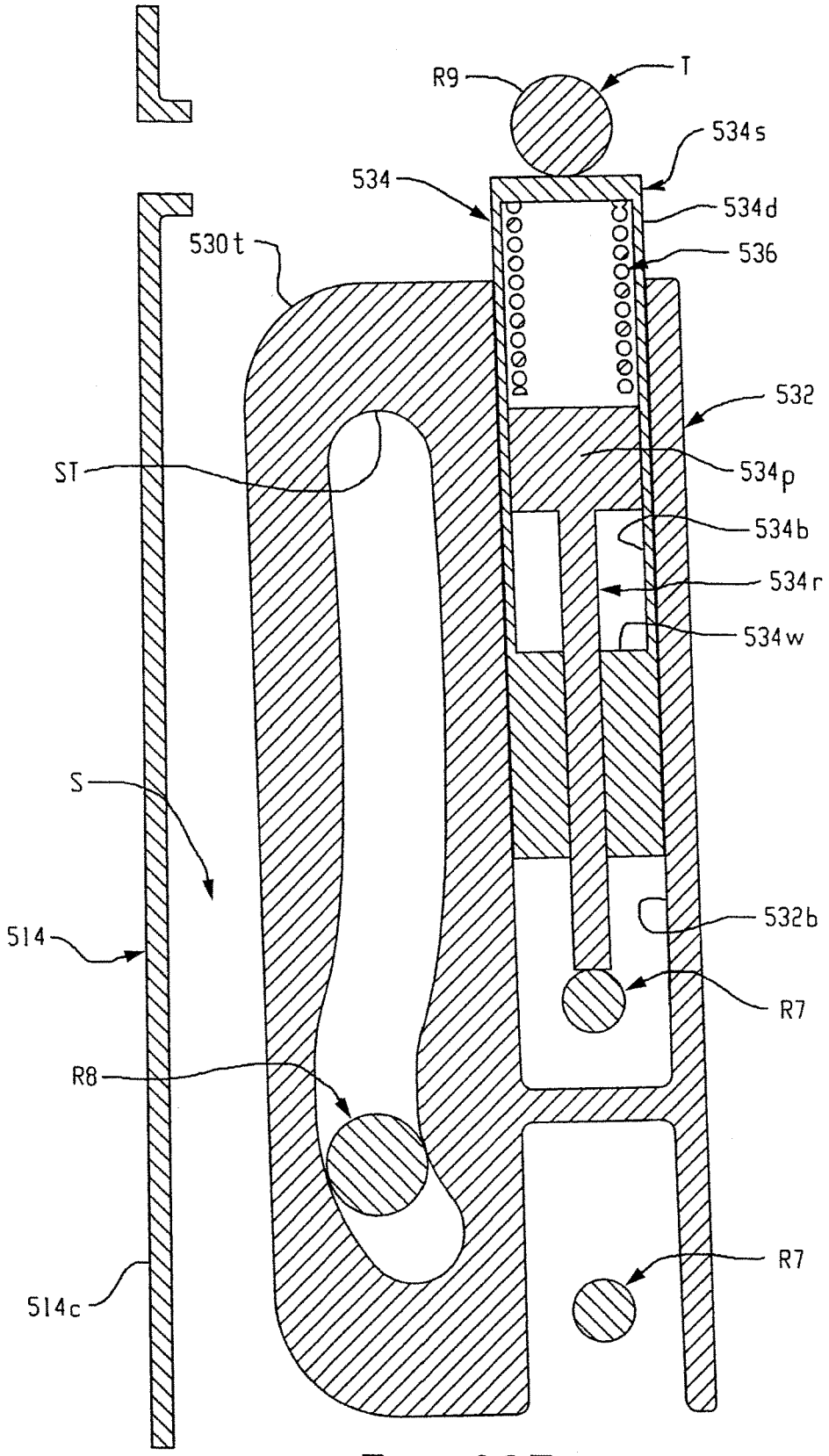
FIG. 22E is an enlarged section view of the snubber system/assembly of the hinge assembly of FIG. 22.

With particular reference to FIG. 22E, the snubber subassembly 530 comprises at least one snubber 534 mounted in a corresponding mounting opening or bore 532*b* (FIG. 22E) of the snubber base 532. In the illustrated embodiment, the snubber 534 is mounted with its piston rod 534*r* oriented inward and abutted with one of the mounting rivets R7 or other location fixed relative to the slide body 518. The snubber 534 comprises a body 534*d* in which the bore 534*b* is defined. The snubber body 534*d* is slidable in the opening/bore 532*b* relative to the snubber base 532 so as to be slidably supported by the snubber base 532. The spring 536, which can be a coil spring, and elastomeric element, a pressurized fluid, or other suitable biasing means, biases the body 534*d* outward toward an extended position in which it protrudes outwardly from the snubber base 532, i.e., out of the opening 534*o* and away from the mounting rivets R7 and away from the channel pivot point P1. The maximum extended position of the body 534*d* relative to the snubber base 532 is limited by an end wall 534*w* of the snubber 534 which limits travel of the body 534*d* relative to the piston 534*p*. A stop T is provided by a rivet R9 that extends between the channel side walls 514*a*,514*b* through the space S, or is provided by another stop structure that is fixed to and/or provided by part of the channel 514 at a location such that the snubber subassembly 530 is located between the stop T and the slide body 518.

As seen in FIG. 22D, the snubber base 532 is slidably but closely received in the space S between the channel side walls 514*a*,514*b* with minimal clearance to ensure that the snubber 534 is always properly aligned and to minimize side loads on the snubber 534. In the illustrated embodiment, the snubber base 532 includes first and second wings 533*a*,533*b* that project outwardly from opposite lateral sides of the snubber base 532 and that extend outwardly so as to slidably abut and/or lie closely adjacent to the first and second side walls 514*a*,514*b*, respectively, in order to minimize lateral movement of the snubber base 532 between the channel side walls 514*a*,514*b*.

Figure 25:
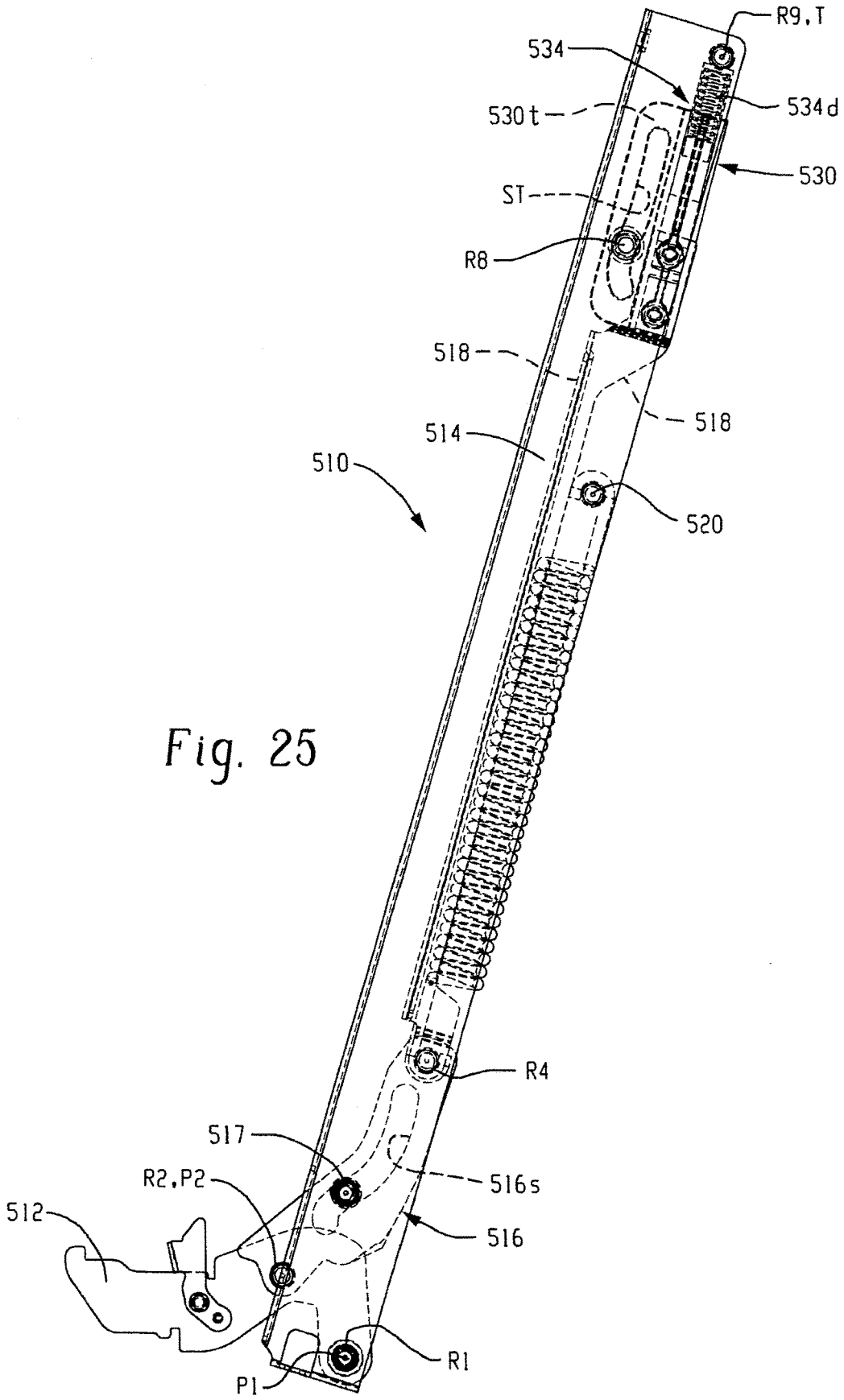
FIG. 25 is a side view that shows the hinge assembly of FIG. 22 in an intermediate position corresponding to a partially opened position of the appliance door.
Figure 26:
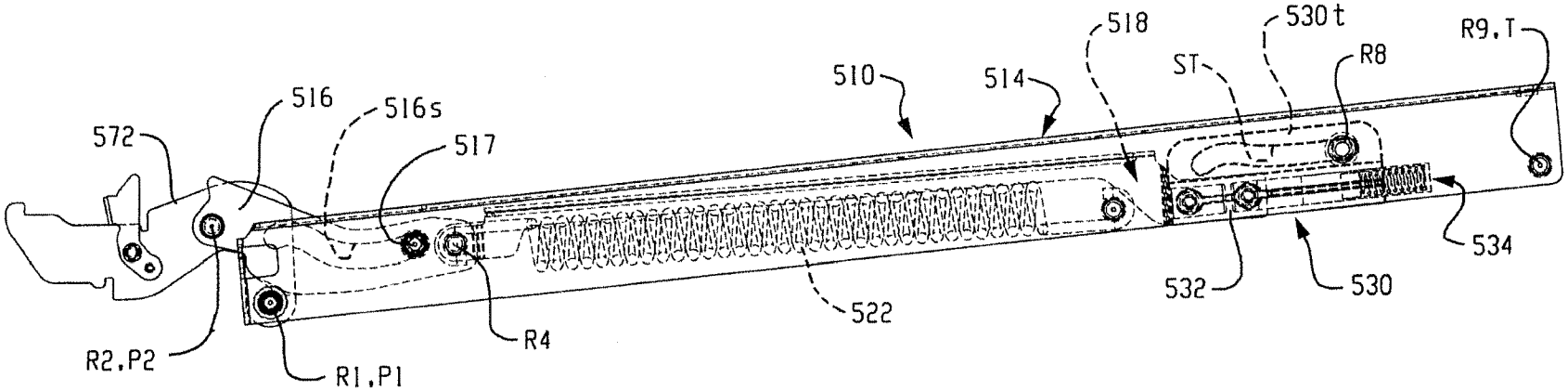
FIG. 26 is a side view that shows the hinge assembly of FIG. 22 in a second position corresponding to a fully-opened position of the appliance door.

FIG. 26 shows the hinge assembly 510 in its second (door-opened) position and it can be seen that the slide body 518 has moved inward toward the channel pivot point P1 and the snubber subassembly 530 has moved with the slide body 518 toward the pivot point P1 away from the stop T. The snubber slot ST moves relative to the guide fastener R8 such that the guide fastener R8 controls the movement and location of the snubber subassembly 530 and slide body 518 when the channel 514 is pivoted from its first (door-closed) position to its second (door-opened) position shown in FIG. 26, and when the channel 514 is pivoted in the opposite direction. In the second (door-opened) position of the hinge assembly 514 (FIG. 26), the snubber body 534*d* is spaced from the rivet R9 or other stop T and is biased to its fully extended position by the spring 536. When the channel 514 is pivoted from this second position toward the first position shown in FIG. 23, it passes through an intermediate position as shown in FIG. 25 where the snubber body 534*d* first contacts the rivet R9 or other stop T. Further pivoting movement of the channel 514 toward the first (door-closed) position will result in continued movement of the slide body 518 and snubber subassembly 530 toward the rivet R9 or other stop T such that the snubber body 534*d* is urged inward relative to the snubber base 532 toward the pivot point P1 and toward its retracted position against the biasing force of the spring 536 and against the damping resistance provided by the piston 534*p* acting on the oil or other fluid contained in the snubber bore 534*b*. This inward movement of the snubber body 534*d* toward its retracted position against the damping resistance of the piston 534*p* acting on the oil or other fluid contained in the bore 534*b* and against the biasing force of the spring 536 damps the movement of the channel 514 toward its first position which correspondingly damps the closing force of the appliance door. When the channel 514 is pivoted in the opposite direction from its first position (FIG. 23) to its second position (FIG. 26), the snubber body 534*d* will be urged by the biasing spring 536 progressively outward toward its extended position as the slide body 518 and snubber subassembly 530 move away from the stop T and the snubber body 534*d* will move to its fully extended position after the channel 514 passes the intermediate location shown in FIG. 25. Those of ordinary skill in the art will recognize that the snubber 534 can alternatively be mounted in the opening/bore 532*b* in an inverted position relative to that shown herein such that its body 534*d* is installed in the opening/bore 532*b* in a fixed position and with the piston rod 534*r* extending outwardly from the opening/bore 532*b* toward the stop T such that the piston rod 534*r* contacts the stop T and the piston 534*p* is urged inward toward its retracted position against the damping resistance of the oil or other fluid contained in the bore 534*b* and biasing force of the spring 536 during movement of the channel 514 from its second (door-opened) position toward its first (door-closed) position to dampen movement of the channel 514 and the associated appliance door connected thereto.

Sixth Embodiment

FIGS. 27-32 show another alternative embodiment of a soft close hinge assembly 610. The hinge assembly 610 is similar to the hinge assembly 110 except as otherwise shown and/or described herein. Like components of the hinge assembly 610 relative to the hinge assembly 110 are shown with corresponding reference numbers that are 500 greater than those used in connection with the hinge assembly 110, and in some cases identical reference characters are used to identify corresponding components relative to the hinge assembly 110. FIGS. 27A, 27B, 27C, 27D are section views as taken at A-A, B-B, C-C, D-D, and E-E of FIG. 27, respectively.

Figure 27:
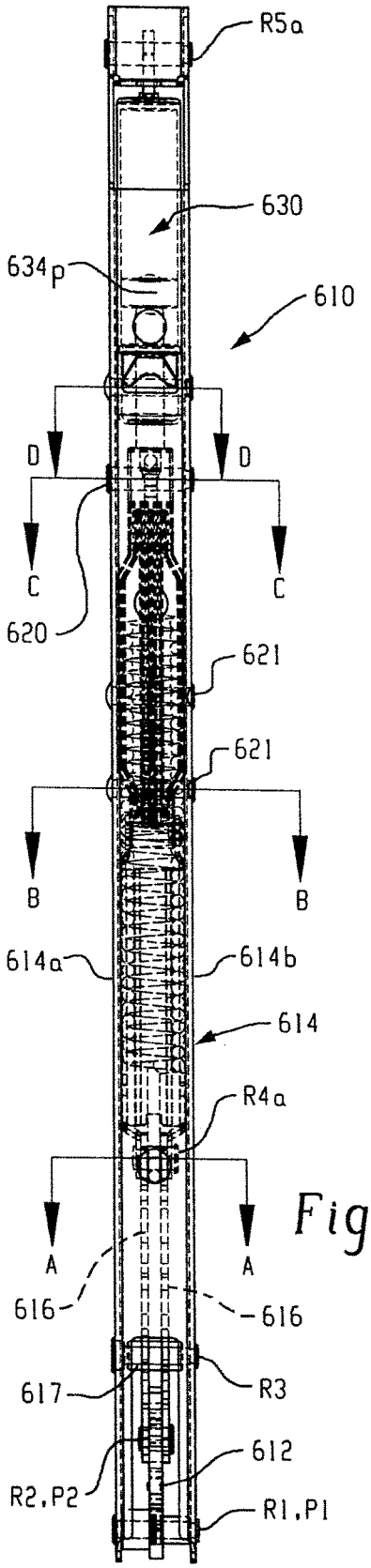
FIGS. 27 and 28 are front and side views that show a hinge assembly in accordance with a sixth embodiment.
Figure 28:
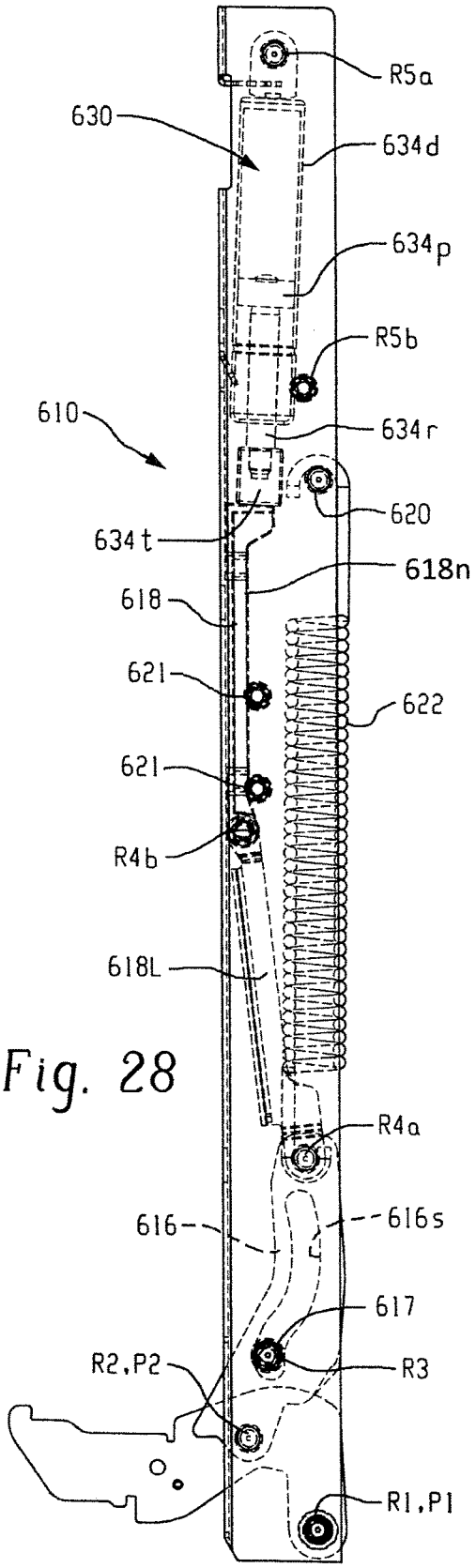
Figure 29:
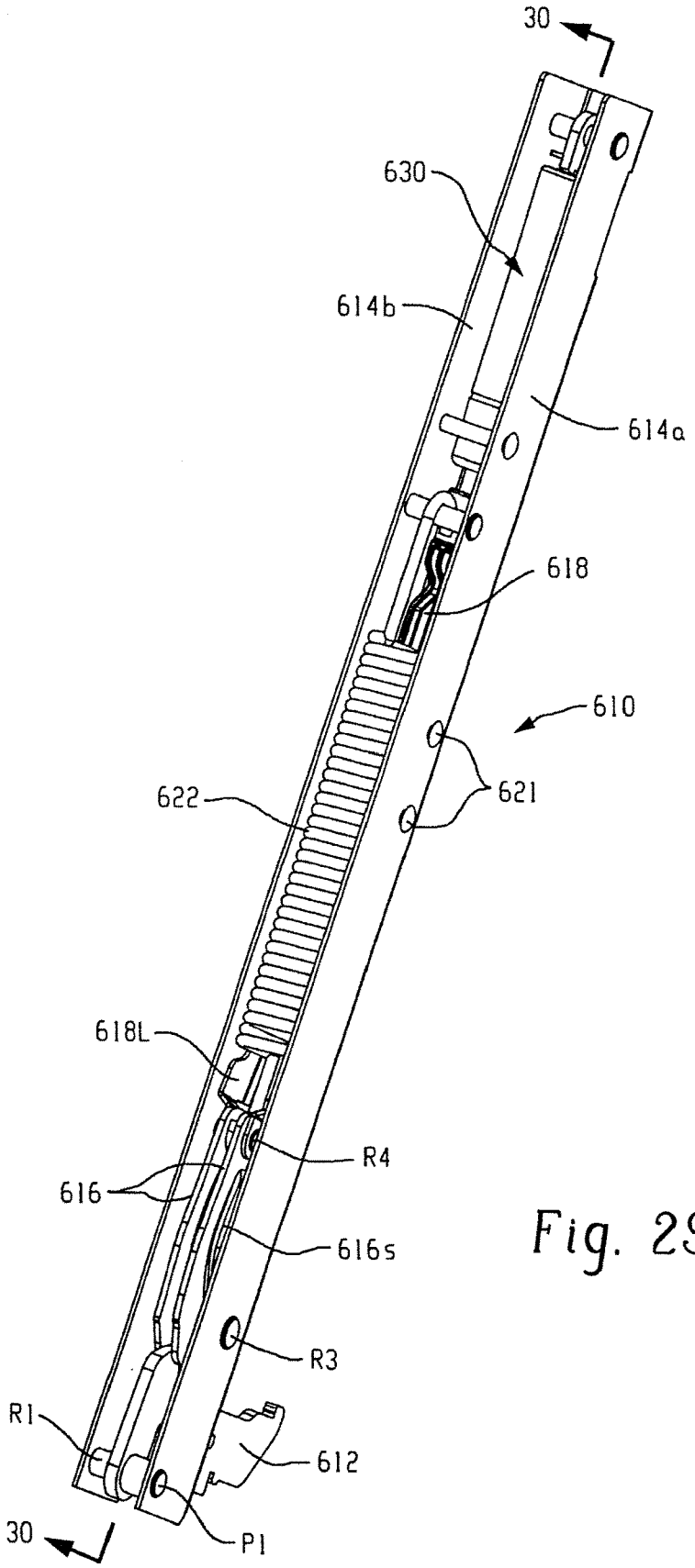
FIG. 29 is an isometric view of the hinge assembly of FIG. 27.
Figure 30:
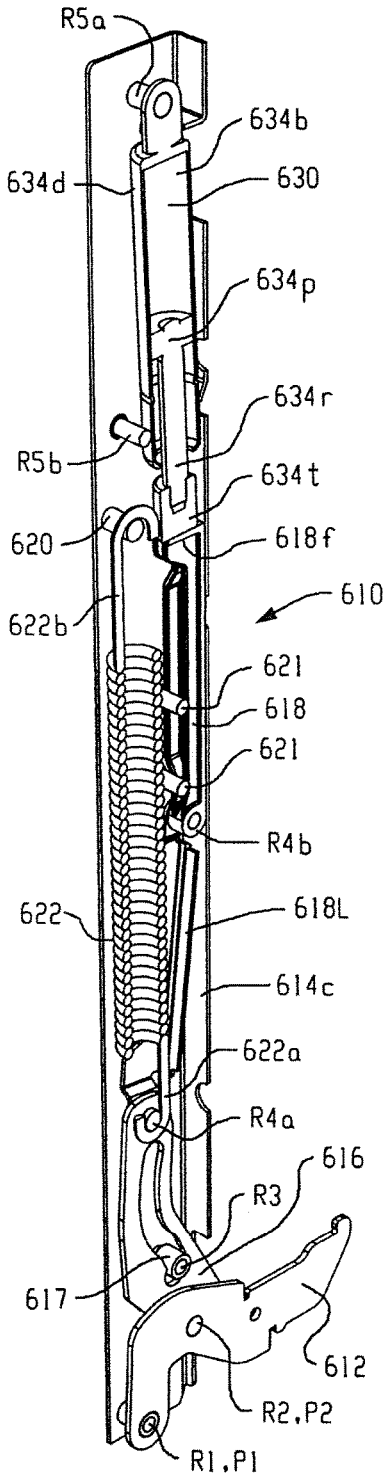
FIG. 30 is a longitudinal section view of the hinge assembly of FIG. 27.
Figure 31:
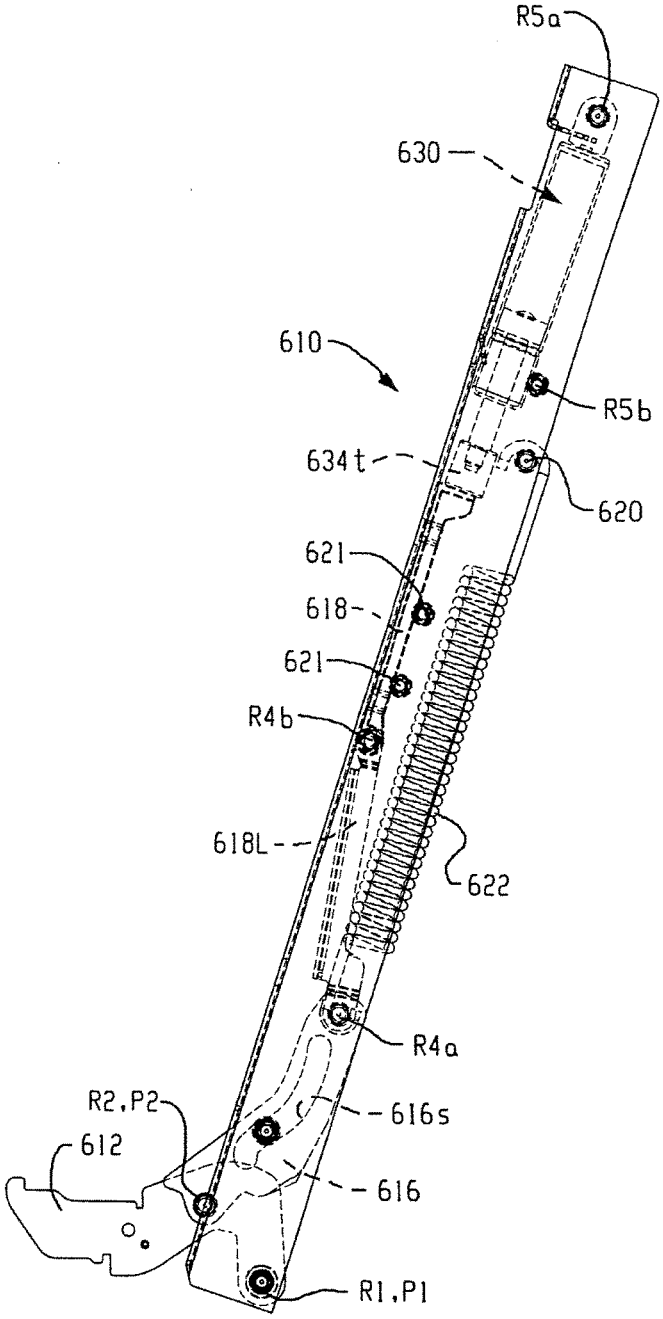
FIG. 31 is a side view that shows the hinge assembly of FIG. 27 in an intermediate position corresponding to a partially opened position of the appliance door.
Figure 32:
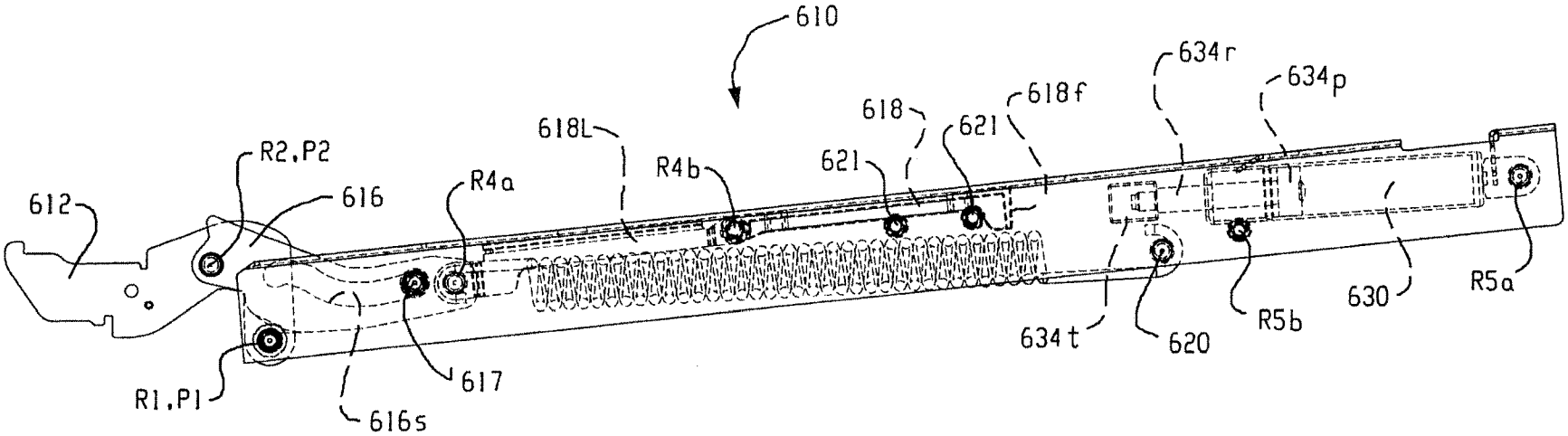
FIG. 32 is a side view that shows the hinge assembly of FIG. 27 in a second position corresponding to a fully-opened position of the appliance door.

FIGS. 27 and 28 are front and side views that show the hinge assembly 610 in its first position that corresponds to the first position in which the appliance door is closed. FIG. 29 is an isometric view of the hinge assembly 610, and FIG. 30 is a section view as taken at line 30-30 of FIG. 29. FIG. 31 is a side view that shows the hinge assembly 610 is an intermediate position corresponding to a partially opened position of the appliance door, and FIG. 32 shows the second position of the hinge assembly 610 corresponding to the fully-opened position of the appliance door.

A primary difference of the hinge assembly 610 relative to the hinge assembly 110 is that the snubber system/subassembly 130 comprises a snubber or damper 630 comprising a hydraulic fluid cylinder, a gas or pneumatic cylinder, a mechanical spring damper, or another self-contained damper device. The snubber/damper 630 comprises a body 634*d* in which a bore 634*b* is defined, and a piston 634*p* is slidably disposed in the bore 634*b*. A rod 634*r* is connected to the piston 634*p* and projects outwardly away from the body 634*d*. A tip 634*t* is connected to or formed as a part of the outermost end of the rod 634*r*. In the illustrated embodiment, the tip 634*t* is metal but other suitable materials can be used. The piston and rod 634*p*,634*r* are biased by pressurized fluid (liquid or gas) and/or by a mechanical spring or other biasing means located in the bore 634*b* to an extended position in which the tip 634*t* of the rod 634*r* projects a maximum distance from the body 634*b* (as shown in FIG. 32), and a retracted position in which the rod and piston 634*r*,634*p* are urged into the bore 634*b* so that the rod tip 634*t* is located closer to the body 634*b* as compared to the extended position (as shown in FIGS. 28 & 30). The damper 630 is secured in the channel space S by a first rivet or other fastener R5*a* that extends through a projecting tab or other part of the body 634*d* and that connects to the channel 614 and by a second rivet or other fastener R5*b* that spans the space S between the channel side walls 614*a*,614*b* and lies adjacent the body 634*d* so as to capture the damper body 634*d* in the space S in abutment with the channel front wall 614*c*.

The hinge assembly 610 comprises a slide body 618 located in the channel space S and adapted for reciprocal sliding movement toward and away from the first pivot point P1. The outer end of the slide body 618 that is spaced a from the first pivot point P1 includes or defines a transverse structure or face 618*f* (FIG. 32) adapted to engage the tip 634*t* of the damper piston rod 634*r* as described above in relation to the hinge assembly 110 wherein the transverse face 118*f* engages the piston rods 134*p* of the snubber subassembly 130.

Figure 27A:
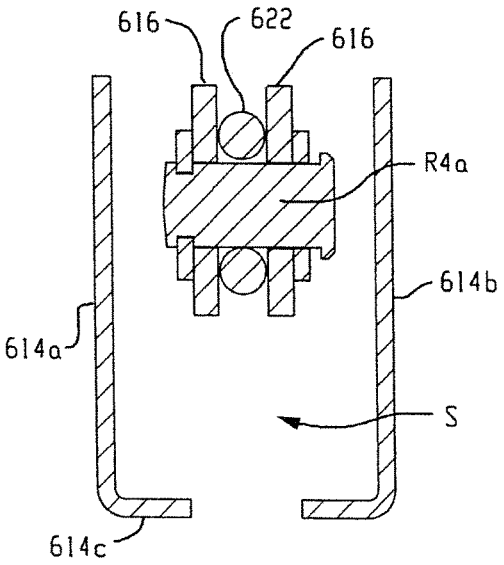
FIGS. 27A, 27B, 27C and 27D are section views taken respectively at lines A-A, B-B, C-C and D-D of FIG. 27.
Figure 27C:
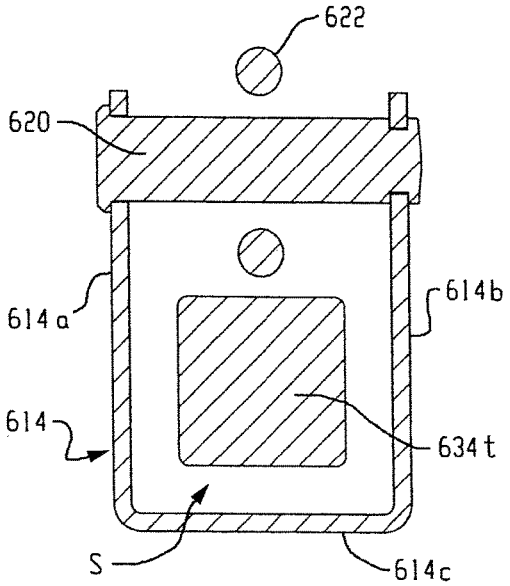
Figure 27B:
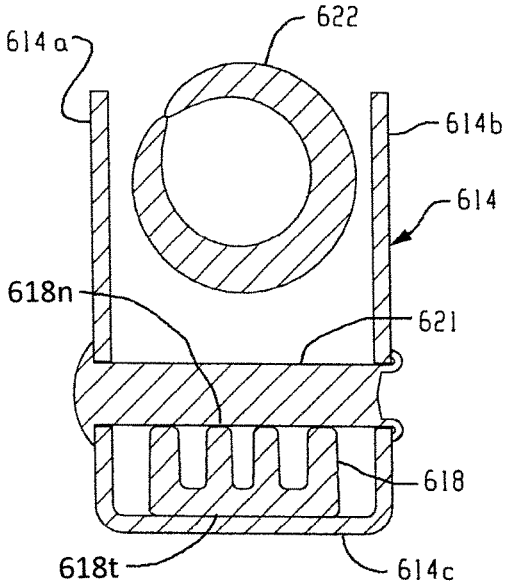
Figure 27D:
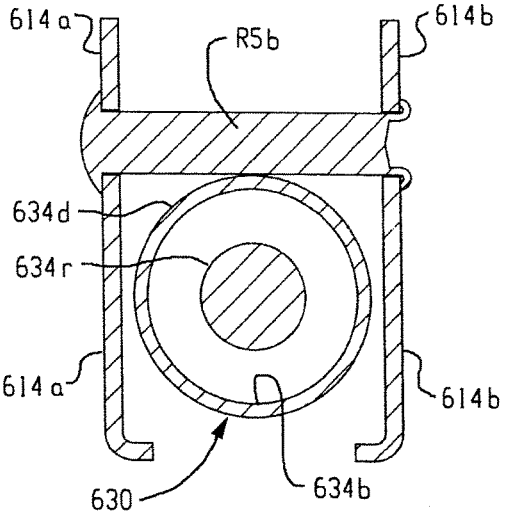

The slide body 618 is connected to the control link(s) 616 by a connector link 618L (or a series of pivotally connected connector links 618L). The connector link 618L can be provided by a single link member (as shown) or multiple parallel link members. The inner end of the connector link 618L (the end closest to the first pivot point P1) is pivotally connected to the outer end of the control link(s) 616 by a rivet or other fastener R4*a*, and the opposite outer end of the connector link 418L is pivotally connected to the inner end of the slide body 618 by a rivet or other fastener R4*b*. The slide body 618 is secured in the space S by at least one slide rivet or slide fastener 621. As shown, first and second slide fasteners 621 extend between the channel side walls 614*a*, 614*b* and capture the slide body 618 in abutment with the channel front wall 614*c*. The slide body 618 is shown as one-piece molded polymeric structure, although other suitable materials can be used. As seen in FIG. 27B, the slide body 618 includes an inner slide face 618*t* that slidably abuts the channel front wall 614*c* and an outer slide face 618*n* that slidably abuts the first and second slide fasteners 621. The slide fasteners 621 can alternatively extend through a slot defined in the slide body 618. Pivoting movement of the channel 614 between its first and second positions causes linear reciprocal sliding movement of the slide body 618 in the channel space S.

The tension coil spring 622 is connected between the control links 616 at its first end 622*a* (e.g., by engagement with the rivet R4) and the channel 614 at its second end 622*b* (e.g., by engagement with the rivet 620 that extends between the channel side walls 614*a*,614*b*) and biases the channel 614 toward its first (door-closed) position.

The damper 630 operates in the same general manner as the snubber subassembly 130 of the embodiment 110 to dampen movement of the channel 614 as the channel 614 moves from its second (door-opened) position as shown in FIG. 32 to its first (door-closed) position as shown in FIG. 28 by abutment of the transverse face 618*f* of the slide body 618 with the tip 634*t* of the damper rod 634*r* beginning when the channel 614 reaches the intermediate position shown in FIG. 31. Further pivoting movement of the channel 614 toward its first position from the intermediate position of FIG. 31 causes the slide body to urge the piston rod and piston 634*r*,634*p* from the extended position toward the retracted position against the damping resistance of the damper 630 provided by movement of the piston 634*p* through a damping fluid such as oil, thereby damping movement of the channel 614 as it moves toward and into its first (door-closed) position.

Other modifications and alterations will occur to those of ordinary skill in the art to which the invention pertains upon reading and understanding this specification. It is intended that the claims be construed as broadly as possible while maintaining their validity to encompass all such modifications and alterations.

The invention claimed is:

1. A hinge assembly for an appliance, said hinge assembly comprising:

a lever arm adapted to be engaged with a mounting receptacle of an associated appliance body;

a channel pivotally connected to the lever arm at a first pivot point, the channel adapted to be connected to an associated appliance door;

a control link comprising inner and outer ends, the inner end of the control link pivotally connected to the lever arm;

a slide body located adjacent the channel and comprising an inner end connected to the outer end of the control link, the slide body adapted for reciprocal sliding movement relative to the channel toward and away from the first pivot point in response to pivoting movement of the channel relative to the lever arm between a first position and a second position;

a spring operably located between the slide body and the channel and resiliently biasing the channel toward the first position;

a snubber system connected to the channel in a location where the slide body is located between the snubber system and the first pivot point, the snubber system comprising at least one snubber comprising a piston that is biased to an extended position and selectively moveable to a retracted position against a damping resistance;

wherein the slide body contacts the snubber system during movement of the slide body away from the first pivot point when the channel moves from the second position toward the first position and the slide body causes movement of the snubber piston from its extended position to its retracted position such that the snubber system damps movement of the slide body away from the first pivot point and damps movement of the channel toward the first position;

wherein said slide body is located between first and second side walls of the channel and includes at least one elongated slot, said hinge assembly comprising a slide pin that extends between the first and second side walls of the channel and through the at least one elongated slot of the slide body; and, wherein the spring includes an outer end connected to the slide pin and includes an inner end connected to at least one of the slide body and control link.

2. The hinge assembly as set forth in claim 1, wherein the inner end of the slide body is connected to the outer end of the control link by a slide body fastener, and wherein the inner end of the spring is engaged with the slide body fastener.

3. A hinge assembly for an appliance, said hinge assembly comprising:

a lever arm adapted to be engaged with a mounting receptacle of an associated appliance body;

a channel pivotally connected to the lever arm at a first pivot point, the channel adapted to be connected to an associated appliance door;

a control link comprising inner and outer ends, the inner end of the control link pivotally connected to the lever arm;

a slide body located adjacent the channel and comprising an inner end connected to the outer end of the control link, the slide body adapted for reciprocal sliding movement relative to the channel toward and away from the first pivot point in response to pivoting movement of the channel relative to the lever arm between a first position and a second position;

a spring operably located between the slide body and the channel and resiliently biasing the channel toward the first position;

a snubber system connected to the channel in a location where the slide body is located between the snubber system and the first pivot point, the snubber system comprising at least one snubber comprising a piston that is biased to an extended position and selectively moveable to a retracted position against a damping resistance;

wherein the slide body contacts the snubber system during movement of the slide body away from the first pivot point when the channel moves from the second position toward the first position and the slide body causes movement of the snubber piston from its extended position to its retracted position such that the snubber system damps movement of the slide body away from the first pivot point and damps movement of the channel toward the first position;

said hinge assembly further comprising a control follower supported between first and second side walls of the channel, wherein said control link comprises an elongated contoured slot, and wherein said control follower is located in said elongated contoured slot.

4. A hinge assembly for an appliance, said hinge assembly comprising:

a lever arm adapted to be engaged with a mounting receptacle of an associated appliance body;

a channel pivotally connected to the lever arm at a first pivot point, the channel adapted to be connected to an associated appliance door;

a control link comprising inner and outer ends, the inner end of the control link pivotally connected to the lever arm;

a slide body located adjacent the channel and comprising an inner end connected to the outer end of the control link, the slide body adapted for reciprocal sliding movement relative to the channel toward and away from the first pivot point in response to pivoting movement of the channel relative to the lever arm between a first position and a second position;

a spring operably located between the slide body and the channel and resiliently biasing the channel toward the first position;

a snubber system connected to the channel in a location where the slide body is located between the snubber system and the first pivot point, the snubber system comprising at least one snubber comprising a piston that is biased to an extended position and selectively moveable to a retracted position against a damping resistance;

wherein the slide body contacts the snubber system during movement of the slide body away from the first pivot point when the channel moves from the second position toward the first position and the slide body causes movement of the snubber piston from its extended position to its retracted position such that the snubber system damps movement of the slide body away from the first pivot point and damps movement of the channel toward the first position; and, wherein the slide body is separated from the snubber system when the channel is moved fully to the second position, the slide body contacts the snubber system when the channel is located in an intermediate position located between the first and second positions, and the slide body maintains continuous contact with the snubber system between the intermediate position and the first position.

5. The hinge assembly as set forth in claim 4, wherein the snubber system comprises a base that supports the at least one snubber, the at least one snubber comprising a piston rod connected to the piston and projecting outwardly from the base toward the first pivot point, wherein the slide body contacts the piston rod for all locations of the channel between and including the intermediate position and said first position.

6. The hinge assembly as set forth in claim 4, wherein the snubber system comprises a base that supports the at least one snubber, wherein the base is slidably connected to the channel and movable toward and away from the first pivot point, the at least one snubber comprising a piston rod connected to the piston and projecting outwardly from the base away from the first pivot point, wherein the slide body contacts at least one of the base and the snubber for all locations of the channel between and including the intermediate position and the first position and the slide body urges the snubber base away from the first pivot point when the channel moves from the intermediate position toward the first position.

7. A hinge assembly for an appliance, said hinge assembly comprising:

a lever arm adapted to be engaged with a mounting receptacle of an associated appliance body;

a channel pivotally connected to the lever arm at a first pivot point, the channel adapted to be connected to an associated appliance door;

a control link comprising inner and outer ends, the inner end of the control link pivotally connected to the lever arm;

a slide body located adjacent the channel and comprising an inner end connected to the outer end of the control link, the slide body adapted for reciprocal sliding movement relative to the channel toward and away from the first pivot point in response to pivoting movement of the channel relative to the lever arm between a first position and a second position;

a spring operably located between the slide body and the channel and resiliently biasing the channel toward the first position;

a snubber system connected to the channel in a location where the slide body is located between the snubber system and the first pivot point, the snubber system comprising at least one snubber comprising a piston that is biased to an extended position and selectively moveable to a retracted position against a damping resistance;

wherein the slide body contacts the snubber system during movement of the slide body away from the first pivot point when the channel moves from the second position toward the first position and the slide body causes movement of the snubber piston from its extended position to its retracted position such that the snubber system damps movement of the slide body away from the first pivot point and damps movement of the channel toward the first position; and, wherein said snubber system comprises first and second snubbers each comprising a piston that is biased to an extended position and selectively moveable to a retracted position against a damping resistance.

8. The hinge assembly as set forth in claim 7, wherein said slide body comprises a spring rod and said spring comprises a helical coil spring through which said spring rod extends, wherein said spring is operatively positioned between said channel and said spring rod and biases said spring rod away from said first pivot point.

9. The hinge assembly as set forth in claim 8, further comprising a connector link comprising inner and outer ends, said inner end of said connector link pivotally connected to the outer end of the control link and the outer end of the connector link pivotally connected to the spring rod.

10. The hinge assembly as set forth in claim 9, wherein said spring rod is located between first and second side walls of the channel, wherein said first and second channel side walls comprise respective elongated slots, said hinge assembly comprising a slide member located in said elongated slots and engaged with said spring rod.

11. A hinge assembly for an appliance, said hinge assembly comprising:

a lever arm adapted to be engaged with a mounting receptacle of an associated appliance body;

a channel pivotally connected to the lever arm at a first pivot point, the channel adapted to be connected to an associated appliance door;

a control link comprising inner and outer ends, the inner end of the control link pivotally connected to the lever arm;

a slide body located adjacent the channel and comprising an inner end connected to the outer end of the control link, the slide body adapted for reciprocal sliding movement relative to the channel toward and away from the first pivot point in response to pivoting movement of the channel relative to the lever arm between a first position and a second position;

a spring operably located between the slide body and the channel and resiliently biasing the channel toward the first position;

a snubber system connected to the channel in a location where the slide body is located between the snubber system and the first pivot point, the snubber system comprising at least one snubber comprising a piston that is biased to an extended position and selectively moveable to a retracted position against a damping resistance;

wherein the slide body contacts the snubber system during movement of the slide body away from the first pivot point when the channel moves from the second position toward the first position and the slide body causes movement of the snubber piston from its extended position to its retracted position such that the snubber system damps movement of the slide body away from the first pivot point and damps movement of the channel toward the first position; and, wherein said at least one snubber of said snubber system comprises at least one of a hydraulic fluid cylinder, a gas or pneumatic cylinder, a mechanical spring damper.

12. A hinge assembly for an appliance, said hinge assembly comprising:

a lever arm adapted to be engaged with a mounting receptacle of an associated appliance body;

a channel pivotally connected to the lever arm at a first pivot point, the channel adapted to be connected to an associated appliance door;

a control link comprising inner and outer ends, the inner end of the control link pivotally connected to the lever arm;

a slide body located adjacent the channel and comprising an inner end connected to the outer end of the control link, the slide body adapted for reciprocal sliding movement relative to the channel toward and away from the first pivot point in response to pivoting movement of the channel relative to the lever arm between a first position and a second position;

a spring operably located between the slide body and the channel and resiliently biasing the channel toward the first position;

a snubber system connected to the channel in a location where the slide body is located between the snubber system and the first pivot point, the snubber system comprising at least one snubber comprising a piston that is biased to an extended position and selectively moveable to a retracted position against a damping resistance;

wherein the slide body contacts the snubber system during movement of the slide body away from the first pivot point when the channel moves from the second position toward the first position and the slide body causes movement of the snubber piston from its extended position to its retracted position such that the snubber system damps movement of the slide body away from the first pivot point and damps movement of the channel toward the first position; and, wherein said at least one snubber is configured to provide more damping resistance during movement of the piston from its extended position toward its retracted position as compared to movement of the piston from its retracted position toward its extended position.

13. A hinge assembly for an appliance, said hinge assembly comprising:

a lever arm adapted to be engaged with a mounting receptacle of an associated appliance body;

a channel pivotally connected to the lever arm at a first pivot point, the channel adapted to be connected to an associated appliance door, said channel comprising a stop;

a control link comprising inner and outer ends, the inner end of the control link pivotally connected to the lever arm;

a slide body located adjacent the channel and comprising an inner end connected to the outer end of the control link, the slide body adapted for reciprocal sliding movement relative to the channel toward and away from the first pivot point in response to pivoting movement of the channel relative to the lever arm between a first position and a second position;

a spring operably located between the slide body and the channel and resiliently biasing the channel toward the first position;

a snubber system connected to the slide body, the snubber system comprising at least one snubber comprising a piston that is biased to an extended position and selectively moveable to a retracted position against a damping resistance;

wherein the slide body and the snubber system move away from the first pivot point when the channel moves from the second position toward the first position, and the snubber system contacts the stop when the channel is located in an intermediate position located between the second position and the first position and movement of the channel from the intermediate position toward the first position causes movement of the snubber piston from its extended position to its retracted position such that the snubber system damps movement of the slide body away from the first pivot point and damps movement of the channel toward the first position; and, wherein said channel comprises first and second spaced-apart side walls, and wherein the snubber system comprises:

a snubber base located between the first and second side walls of the channel and supporting said at least one snubber, said snubber base comprising an elongated slot;

a guide fastener connected to and extending between the first and second side walls of the channel and extending through the elongated slot of the snubber base to slidably capture the snubber base to the channel.

14. The hinge assembly as set forth in claim 13, wherein said snubber base is fixedly secured to said slide body by a mounting fastener, and wherein said at least one snubber comprises:

a snubber body slidably supported by the snubber base and defining a bore in which said piston is slidably supported, said snubber body projecting outwardly from said snubber base;

a piston rod connected to the piston and projecting outwardly from said bore toward said first pivot point, said piston rod in contact with said mounting fastener;

wherein said snubber body contacts said stop and is moved toward said first pivot point and said piston is moved toward its retracted position upon movement of said channel from said intermediate position toward said first position.

15. A hinge assembly for an appliance, said hinge assembly comprising:

a lever arm adapted to be engaged with a mounting receptacle of an associated appliance body;

a channel pivotally connected to the lever arm at a first pivot point, the channel adapted to be connected to an associated appliance door;

a control link comprising inner and outer ends, the inner end of the control link pivotally connected to the lever arm;

a slide body located adjacent the channel and operatively connected to the control link, the slide body adapted for reciprocal movement relative to the channel toward and away from the first pivot point in response to pivoting movement of the channel relative to the lever arm between a first position and a second position;

a spring operatively engaged between the channel and the control link and resiliently biasing the channel toward the first position;

a damper connected to the channel at a location where the slide body is located between the damper and the first pivot point, the damper comprising: (i) a damper body including a bore; (ii) a piston slidably located in the bore; and, (iii) a rod connected to the piston and extending outwardly away from the damper body, said piston biased to an extended position and selectively moveable to a retracted position against a damping resistance;

wherein the slide body contacts the damper during movement of the slide body away from the first pivot point when the channel moves from the second position toward the first position and the slide body causes movement of the piston from its extended position to its retracted position against said damping resistance such that the damper cushions movement of the slide body away from the first pivot point and cushions movement of the channel toward the first position;

said inner end of said slide body operatively connected to the outer end of the control link by a connector link; and, said slide body captured adjacent said channel such that said slide body moves relative to said channel in a linear reciprocal manner when said channel is pivoted between the first and second positions.

16. The hinge assembly as set forth in claim 15, further comprising at least one slide fastener connected to said channel, wherein said at least one slide fastener captures said slide body adjacent a wall of said channel.

* * * * *